US012065230B1

(12) United States Patent
Derginer et al.

(10) Patent No.: US 12,065,230 B1
(45) Date of Patent: Aug. 20, 2024

(54) MARINE PROPULSION CONTROL SYSTEM AND METHOD WITH REAR AND LATERAL MARINE DRIVES

(71) Applicant: Brunswick Corporation, Mettawa, IL (US)

(72) Inventors: Matthew E. Derginer, Butte des Morts, WI (US); Kyle F. Karnick, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 177 days.

(21) Appl. No.: 17/672,339

(22) Filed: Feb. 15, 2022

(51) Int. Cl.

| | |
|---|---|
| ***B63H 20/12*** | (2006.01) |
| ***B63H 20/00*** | (2006.01) |
| ***B63H 25/02*** | (2006.01) |
| ***B63H 25/42*** | (2006.01) |

(52) U.S. Cl.
CPC ..... *B63H 20/12* (2013.01); *B63H 25/42* (2013.01); *B63H 2020/003* (2013.01); *B63H 25/02* (2013.01); *B63H 2025/026* (2013.01)

(58) Field of Classification Search
CPC ..... B63H 20/12; B63H 11/04; B63H 1/16; B63H 20/007; B63H 25/02; B63H 21/21; B63H 25/42; B63B 1/08; B63B 27/10; B63B 29/02; B63B 43/18; B63B 34/75; G21G 1/04
See application file for complete search history.

(56) References Cited

U.S. PATENT DOCUMENTS

| | | | |
|---|---|---|---|
| 3,688,252 | A | 8/1972 | Thompson |
| 3,715,571 | A | 2/1973 | Braddon |
| 3,754,399 | A | 8/1973 | Ono et al. |
| 3,771,483 | A | 11/1973 | Spencer |

(Continued)

FOREIGN PATENT DOCUMENTS

| | | | |
|---|---|---|---|
| CN | 106864696 | B | 1/2019 |
| CN | 109639314 | A | 4/2019 |

(Continued)

OTHER PUBLICATIONS

"Joystick Driving: Experience a New and Intuitive Way of Boat Driving," Volvo Penta, Goteborg, Sweden, Mar. 2017, 2 pages.

(Continued)

*Primary Examiner* — Yuri Kan
(74) *Attorney, Agent, or Firm* — Andrus Intellectual Property Law, LLP

(57) ABSTRACT

A marine propulsion system for propelling a marine vessel includes at least two steerable rear marine drives that each generate forward and reverse thrusts, wherein each rear marine drive is independently steerable to a range of steering angles, and a lateral marine drive configured to generate starboard and port thrusts on the marine vessel. The system further includes a user input device, such as a joystick, operable by a user to provide a propulsion demand input commanding lateral movement of the marine vessel and rotational movement of the marine vessel. A control system is included that is configured to control steering and thrust of each of the at least two rear marine drives and thrust of the lateral marine drive based on the propulsion demand input so as to generate the lateral movement and/or the rotational movement commanded by the user.

26 Claims, 11 Drawing Sheets

(56) References Cited

U.S. PATENT DOCUMENTS 3,842,789 A 10/1974 Bergstedt
4,231,310 A 11/1980 Muramatsu
4,253,149 A 2/1981 Cunningham et al.
4,428,052 A 1/1984 Robinson et al.
4,501,560 A 2/1985 Brandt et al.
4,513,378 A 4/1985 Antkowiak
4,589,850 A 5/1986 Soderbaum
4,625,583 A 12/1986 Kronogard
4,643,687 A 2/1987 Yano et al.
4,652,878 A 3/1987 Borgersen
4,741,713 A 5/1988 Ohlsson et al.
4,781,631 A 11/1988 Uchida et al.
4,813,895 A 3/1989 Takahashi
4,892,494 A 1/1990 Ferguson
4,939,661 A 7/1990 Barker et al.
4,975,709 A 12/1990 Koike
5,067,918 A 11/1991 Kobayashi
5,172,324 A 12/1992 Knight
5,202,835 A 4/1993 Knight
5,331,558 A 7/1994 Hossfield et al.
5,362,263 A 11/1994 Petty
5,386,368 A 1/1995 Knight
5,390,125 A 2/1995 Sennott et al.
5,491,636 A 2/1996 Robertson et al.
5,736,962 A 4/1998 Tendler
5,884,213 A 3/1999 Carlson
6,059,226 A 5/2000 Cotton et al.
6,092,007 A 7/2000 Cotton et al.
6,113,443 A 9/2000 Eichinger
6,142,841 A 11/2000 Alexander, Jr. et al.
6,146,219 A 11/2000 Blanchard
6,230,642 B1 5/2001 McKenney et al.
6,234,100 B1 5/2001 Fadeley et al.
6,234,853 B1 5/2001 Lanyi et al.
6,279,499 B1 8/2001 Griffith, Sr. et al.
6,308,651 B2 10/2001 McKenney et al.
6,309,160 B1 * 10/2001 Greene, Jr. ..... B63B 27/10 414/139.5
6,336,833 B1 1/2002 Rheault et al.
6,340,290 B1 1/2002 Schott et al.
6,342,775 B1 1/2002 Sleder, Sr.
6,350,164 B1 2/2002 Griffith, Sr. et al.
6,354,237 B1 3/2002 Gaynor et al.
6,354,892 B1 3/2002 Staerzl
6,361,387 B1 3/2002 Clarkson
6,363,874 B1 4/2002 Griffith, Sr.
6,377,889 B1 4/2002 Soest
6,402,577 B1 6/2002 Treinen et al.
6,416,368 B1 7/2002 Griffith, Sr. et al.
6,428,371 B1 8/2002 Michel et al.
6,446,003 B1 9/2002 Green et al.
6,485,341 B1 11/2002 Layni et al.
6,488,552 B2 12/2002 Kitsu et al.
6,511,354 B1 1/2003 Gonring et al.
6,582,260 B2 6/2003 Nemoto et al.
6,583,728 B1 6/2003 Staerzl
6,604,479 B2 8/2003 McKenney et al.
6,678,589 B2 1/2004 Robertson et al.
6,705,907 B1 3/2004 Hedlund
6,743,062 B1 6/2004 Jones
6,773,316 B1 8/2004 Keehn, Jr.
6,848,382 B1 2/2005 Bekker
6,875,065 B2 4/2005 Tsuchiya et al.
6,884,130 B2 4/2005 Okabe
6,885,919 B1 4/2005 Wyant et al.
6,910,927 B2 6/2005 Kanno
6,923,136 B1 8/2005 D'Alessandro
6,964,590 B1 * 11/2005 Ha ..... B63H 1/16 114/151
6,994,046 B2 2/2006 Kaji et al.
6,995,527 B2 2/2006 Depasqua
7,001,230 B2 2/2006 Saito
RE39,032 E 3/2006 Gonring et al.
7,018,252 B2 3/2006 Simard et al.
7,036,445 B2 5/2006 Kaufmann et al.
7,059,922 B2 6/2006 Kawanishi
7,118,434 B2 10/2006 Arvidsson et al.
7,127,333 B2 10/2006 Arvidsson
7,128,625 B2 10/2006 Saito
7,131,386 B1 11/2006 Caldwell
7,188,581 B1 3/2007 Davis et al.
7,243,009 B2 7/2007 Kaji
7,267,068 B2 9/2007 Bradley et al.
7,268,703 B1 9/2007 Kabel et al.
7,305,928 B2 12/2007 Bradley et al.
7,366,593 B2 4/2008 Fujimoto et al.
7,389,165 B2 6/2008 Kaji
7,389,735 B2 6/2008 Kaji et al.
7,398,742 B1 7/2008 Gonring
7,416,458 B2 8/2008 Suemori et al.
7,438,013 B2 10/2008 Mizutani
7,467,595 B1 12/2008 Lanyi et al.
7,476,134 B1 1/2009 Fell et al.
7,481,688 B2 1/2009 Kobayashi
7,506,599 B2 3/2009 Mizutani
7,527,537 B2 5/2009 Mizutani
7,533,624 B2 5/2009 Mizutani
7,538,511 B2 5/2009 Samek
7,540,253 B2 6/2009 Mizutani
7,577,526 B2 8/2009 Kim et al.
7,674,145 B2 3/2010 Okuyama et al.
7,727,036 B1 6/2010 Poorman et al.
7,736,204 B2 6/2010 Kaji
7,753,745 B2 7/2010 Schey et al.
7,813,844 B2 10/2010 Gensler et al.
7,844,374 B2 11/2010 Mizutani
7,876,430 B2 1/2011 Montgomery
7,883,383 B2 2/2011 Larsson
7,930,986 B2 4/2011 Mizutani
7,959,479 B2 6/2011 Ryuman et al.
7,972,189 B2 7/2011 Urano
8,011,981 B2 9/2011 Mizutani
8,046,121 B2 10/2011 Mizutani
8,050,630 B1 11/2011 Arbuckle
8,051,792 B2 11/2011 Mochizuki
8,079,822 B2 12/2011 Kitsunai et al.
8,082,100 B2 12/2011 Grace et al.
8,105,046 B2 1/2012 Kitsunai et al.
8,113,892 B1 2/2012 Gable et al.
8,131,412 B2 3/2012 Larsson et al.
8,145,370 B2 3/2012 Borrett
8,145,371 B2 3/2012 Rae et al.
8,155,811 B2 4/2012 Noffsinger et al.
8,170,734 B2 5/2012 Kaji
8,170,735 B2 5/2012 Kaji
8,195,381 B2 6/2012 Arvidsson
8,265,812 B2 9/2012 Pease
8,271,155 B2 9/2012 Arvidsson
8,276,534 B2 10/2012 Mochizuki
8,277,270 B2 10/2012 Ryuman
8,376,793 B2 2/2013 Chiecchi
8,417,399 B2 4/2013 Arbuckle et al.
8,428,801 B1 4/2013 Nose et al.
8,478,464 B2 7/2013 Arbuckle et al.
8,480,445 B2 7/2013 Morvillo
8,510,028 B2 8/2013 Grace et al.
8,515,660 B2 8/2013 Grace et al.
8,515,661 B2 8/2013 Grace et al.
8,527,192 B2 9/2013 Grace et al.
8,543,324 B2 9/2013 Grace et al.
8,622,012 B2 1/2014 Olofsson
8,645,012 B2 2/2014 Salmon et al.
8,682,515 B2 3/2014 Ito
8,688,298 B2 4/2014 Mizutani et al.
8,694,248 B1 4/2014 Arbuckle et al.
8,761,976 B2 6/2014 Salmon et al.
8,797,141 B2 8/2014 Best et al.
8,807,058 B1 * 8/2014 Roche, IV ..... B63H 11/04 440/38
8,831,802 B2 9/2014 Mizutani et al.
8,831,868 B2 9/2014 Grace et al.
8,838,305 B2 9/2014 Mizutani
8,944,865 B1 2/2015 Krabacher et al.
8,965,606 B2 2/2015 Mizutani

(56) References Cited

U.S. PATENT DOCUMENTS 8,983,780 B2 3/2015 Kato et al.
9,032,891 B2 5/2015 Kinoshita et al.
9,032,898 B2 5/2015 Widmark
9,033,752 B2 5/2015 Takase
9,039,468 B1 5/2015 Arbuckle et al.
9,039,469 B1 5/2015 Calamia et al.
9,079,651 B2 7/2015 Nose et al.
9,108,710 B1 8/2015 McChesney et al.
9,126,667 B2 9/2015 Mizutani
9,132,900 B2 9/2015 Salmon et al.
9,150,294 B2 10/2015 Ito et al.
9,150,298 B2 10/2015 Mizushima
9,162,743 B1 10/2015 Grace et al.
9,176,215 B2 11/2015 Nikitin et al.
9,183,711 B2 11/2015 Fiorini et al.
9,195,234 B2 11/2015 Stephens
9,216,795 B2 * 12/2015 McGill, Jr. ..... B63B 1/08
9,248,898 B1 2/2016 Kirchhoff
9,261,048 B2 2/2016 Suzuki et al.
9,278,740 B1 3/2016 Andrasko et al.
9,296,456 B2 3/2016 Mochizuki et al.
9,355,463 B1 5/2016 Arambel et al.
9,359,057 B1 6/2016 Andrasko et al.
9,376,188 B2 6/2016 Okamoto
9,377,780 B1 6/2016 Arbuckle et al.
9,440,724 B2 9/2016 Suzuki et al.
9,545,988 B2 1/2017 Clark
9,594,374 B2 3/2017 Langford-Wood
9,594,375 B2 3/2017 Jopling
9,598,160 B2 3/2017 Andrasko et al.
9,615,006 B2 4/2017 Terre et al.
9,616,971 B2 4/2017 Gai
9,650,119 B2 5/2017 Morikami et al.
9,663,211 B2 5/2017 Suzuki
9,694,885 B2 7/2017 Combee
9,718,530 B2 8/2017 Kabel et al.
9,727,202 B2 8/2017 Bamba
9,729,802 B2 8/2017 Frank et al.
9,733,645 B1 8/2017 Andrasko et al.
9,734,583 B2 8/2017 Walker et al.
9,764,807 B2 9/2017 Frisbie et al.
9,862,473 B2 1/2018 Rydberg et al.
9,878,769 B2 1/2018 Kinoshita et al.
9,996,083 B2 1/2018 Vojak
9,904,293 B1 2/2018 Heap et al.
9,908,605 B2 3/2018 Hayashi et al.
9,927,520 B1 3/2018 Ward et al.
9,937,984 B2 4/2018 Herrington et al.
9,950,778 B2 4/2018 Kabel et al.
9,963,214 B2 5/2018 Watanabe et al.
9,969,473 B2 5/2018 Okamoto
9,988,134 B1 6/2018 Gable et al.
10,011,342 B2 7/2018 Gai et al.
10,025,312 B2 7/2018 Langford-Wood
10,037,701 B2 7/2018 Harnett
10,048,690 B1 8/2018 Hilbert et al.
10,055,648 B1 8/2018 Grigsby et al.
10,071,793 B2 9/2018 Koyano et al.
10,078,332 B2 9/2018 Tamura et al.
10,094,309 B2 10/2018 Hagiwara et al.
10,095,232 B1 10/2018 Arbuckle et al.
10,106,238 B2 10/2018 Sidki et al.
10,124,870 B2 11/2018 Bergmann et al.
10,191,153 B2 1/2019 Gatland
10,191,490 B2 1/2019 Akuzawa et al.
10,431,099 B2 1/2019 Stewart et al.
10,198,005 B2 2/2019 Arbuckle et al.
10,202,177 B1 * 2/2019 Hartman ..... B63B 34/75
10,259,555 B2 4/2019 Ward et al.
10,281,917 B2 5/2019 Tyers
10,322,778 B2 6/2019 Widmark et al.
10,330,031 B2 6/2019 Ohsara et al.
10,336,426 B2 7/2019 Naito et al.
10,338,800 B2 7/2019 Rivers et al.
10,372,976 B2 8/2019 Kollmann et al.
10,377,458 B1 8/2019 McGinley
10,437,248 B1 10/2019 Ross et al.
10,444,349 B2 10/2019 Gatland
10,457,371 B2 10/2019 Hara et al.
10,464,647 B2 11/2019 Tokuda
10,472,036 B2 11/2019 Spengler et al.
10,501,161 B2 12/2019 Tamura et al.
10,507,899 B2 12/2019 Imamura et al.
10,562,602 B1 2/2020 Gable et al.
10,618,617 B2 4/2020 Suzuki et al.
10,625,837 B2 4/2020 Ichikawa et al.
10,633,072 B1 4/2020 Arbuckle et al.
10,640,190 B1 5/2020 Gonring
10,671,073 B2 6/2020 Arbuckle et al.
10,739,771 B2 8/2020 Miller et al.
10,760,470 B2 9/2020 Li et al.
10,782,692 B2 9/2020 Tamura et al.
10,787,238 B2 9/2020 Watanabe et al.
10,795,366 B1 10/2020 Arbuckle et al.
10,845,811 B1 11/2020 Arbuckle et al.
10,871,775 B2 12/2020 Hashizume et al.
10,884,416 B2 1/2021 Whiteside et al.
10,913,524 B1 2/2021 Wald et al.
10,921,802 B2 2/2021 Bertrand et al.
10,926,855 B2 2/2021 Derginer et al.
10,953,973 B2 3/2021 Hayashi et al.
11,008,926 B1 5/2021 Osthelder et al.
11,009,880 B2 5/2021 Miller et al.
11,021,220 B2 6/2021 Yamamoto et al.
11,072,399 B2 7/2021 Terada
11,091,243 B1 8/2021 Gable et al.
11,117,643 B2 9/2021 Sakashita et al.
11,161,575 B2 11/2021 Koyano et al.
11,247,753 B2 2/2022 Arbuckle et al.
11,370,520 B1 * 6/2022 Yamaguchi ..... B63H 25/42
2002/0127926 A1 9/2002 Michel et al.
2003/0137445 A1 7/2003 Rees et al.
2004/0221787 A1 11/2004 McKenney et al.
2005/0075016 A1 4/2005 Bertetti et al.
2005/0170713 A1 8/2005 Okuyama
2006/0012248 A1 1/2006 Matsushita et al.
2006/0058929 A1 3/2006 Fossen et al.
2006/0089794 A1 4/2006 Despasqua
2006/0126771 A1 * 6/2006 Da Conceicao ..... G21G 1/04
376/100
2006/0217011 A1 9/2006 Morvillo
2007/0017426 A1 1/2007 Kaji et al.
2007/0032923 A1 2/2007 Mossman et al.
2007/0066157 A1 * 3/2007 Yamashita ..... B63H 20/12
440/63
2007/0089660 A1 4/2007 Bradley et al.
2007/0178779 A1 8/2007 Takada et al.
2007/0203623 A1 8/2007 Saunders et al.
2009/0037040 A1 2/2009 Salmon et al.
2009/0111339 A1 4/2009 Suzuki
2010/0076683 A1 3/2010 Chou
2010/0138083 A1 6/2010 Kaji
2011/0104965 A1 5/2011 Atsusawa
2011/0153125 A1 6/2011 Arbuckle et al.
2011/0172858 A1 7/2011 Gustin et al.
2012/0072059 A1 3/2012 Glaeser
2012/0248259 A1 10/2012 Page et al.
2013/0297104 A1 11/2013 Tyers et al.
2014/0046515 A1 * 2/2014 Mizutani ..... B63H 21/21
701/21
2015/0032305 A1 1/2015 Lindeborg
2015/0089427 A1 3/2015 Akuzawa
2015/0276923 A1 10/2015 Song et al.
2015/0346722 A1 12/2015 Herz et al.
2015/0378361 A1 12/2015 Walker et al.
2016/0214534 A1 7/2016 Richards et al.
2017/0176586 A1 6/2017 Johnson et al.
2017/0205829 A1 7/2017 Tyers
2017/0253314 A1 9/2017 Ward
2017/0255201 A1 9/2017 Arbuckle et al.
2017/0365175 A1 12/2017 Harnett
2018/0046190 A1 2/2018 Hitachi et al.
2018/0057132 A1 3/2018 Ward et al.
2018/0081054 A1 3/2018 Rudzinsky et al.

(56) References Cited

U.S. PATENT DOCUMENTS

| | | | | |
|---|---|---|---|---|
| 2018/0122351 | A1 | 5/2018 | Simonton | |
| 2018/0259338 | A1 | 9/2018 | Stokes et al. | |
| 2018/0259339 | A1 | 9/2018 | Johnson et al. | |
| 2019/0202541 | A1* | 7/2019 | Pettersson | B63H 25/02 |
| 2019/0251356 | A1 | 8/2019 | Rivers | |
| 2019/0258258 | A1 | 8/2019 | Tyers | |
| 2019/0283855 | A1 | 9/2019 | Nilsson | |
| 2019/0382090 | A1 | 12/2019 | Suzuki et al. | |
| 2020/0108902 | A1 | 4/2020 | Wong et al. | |
| 2020/0130797 | A1 | 4/2020 | Mizutani | |
| 2020/0247518 | A1 | 8/2020 | Dannenberg | |
| 2020/0249678 | A1 | 8/2020 | Arbuckle et al. | |
| 2020/0269962 | A1 | 8/2020 | Gai et al. | |
| 2020/0290712 | A1* | 9/2020 | Duclos | B63B 1/042 |
| 2020/0298941 | A1 | 9/2020 | Terada et al. | |
| 2020/0298942 | A1 | 9/2020 | Terada et al. | |
| 2020/0324864 | A1 | 10/2020 | Inoue | |
| 2020/0331572 | A1 | 10/2020 | Inoue | |
| 2020/0361587 | A1 | 11/2020 | Husberg | |
| 2020/0369351 | A1 | 11/2020 | Behrendt et al. | |
| 2020/0391838 | A1 | 12/2020 | Inoue et al. | |
| 2020/0391840 | A1 | 12/2020 | Inoue et al. | |
| 2020/0398964 | A1 | 12/2020 | Fujima et al. | |
| 2021/0061426 | A1 | 3/2021 | Gai et al. | |
| 2021/0070407 | A1 | 3/2021 | Ishii | |
| 2021/0070414 | A1 | 3/2021 | Bondesson et al. | |
| 2021/0086876 | A1 | 3/2021 | Inque et al. | |
| 2021/0088667 | A1 | 3/2021 | Heling et al. | |
| 2021/0107617 | A1 | 4/2021 | Nakatani | |
| 2021/0141396 | A1 | 5/2021 | Kinoshita | |
| 2021/0147053 | A1 | 5/2021 | Motose et al. | |
| 2021/0155333 | A1 | 5/2021 | Mizutani | |
| 2021/0163114 | A1 | 6/2021 | Bondesson et al. | |
| 2021/0166568 | A1* | 6/2021 | Kersulec | B63B 43/18 |
| 2021/0179244 | A1 | 6/2021 | Mizutani | |
| 2021/0197940 | A1 | 7/2021 | Takase | |
| 2021/0197944 | A1 | 7/2021 | Takase | |
| 2021/0255627 | A1 | 8/2021 | Snyder et al. | |
| 2021/0261229 | A1 | 8/2021 | Terada | |
| 2021/0263516 | A1 | 8/2021 | Miller et al. | |
| 2021/0286362 | A1 | 9/2021 | Malouf et al. | |
| 2021/0291943 | A1 | 9/2021 | Inque et al. | |
| 2021/0347449 | A1 | 11/2021 | Dake et al. | |
| 2021/0371074 | A1* | 12/2021 | Lammers-Meis | B63H 20/007 |
| 2022/0001962 | A1* | 1/2022 | Krosschell | B63B 29/02 |

FOREIGN PATENT DOCUMENTS

| | | | |
|---|---|---|---|
| CN | 209008841 | U | 6/2019 |
| CN | 209192180 | U | 8/2019 |
| CN | 209321220 | U | 8/2019 |
| CN | 209410311 | U | 9/2019 |
| CN | 209410312 | U | 9/2019 |
| CN | 209410313 | U | 9/2019 |
| CN | 209410315 | U | 9/2019 |
| CN | 210101960 | U | 2/2020 |
| CN | 210101961 | U | 2/2020 |
| CN | 210191790 | U | 3/2020 |
| CN | 109625191 | B | 4/2020 |
| CN | 109693776 | B | 4/2020 |
| CN | 109591992 | B | 3/2021 |
| CN | 112968511 | A | 6/2021 |
| EP | 1 775 212 | | 4/2007 |
| EP | 2536622 | | 12/2012 |
| EP | 2536622 | A1 | 12/2012 |
| EP | 1923307 | | 2/2013 |
| EP | 1923309 | | 5/2013 |
| EP | 1923308 | | 6/2013 |
| EP | 2813423 | | 8/2016 |
| EP | 3 182 155 | | 6/2017 |
| EP | 2250077 | | 2/2018 |
| EP | 2703279 | | 6/2018 |
| EP | 3643597 | | 4/2020 |
| EP | 3354557 | B1 | 5/2020 |
| EP | 3498589 | | 7/2020 |
| EP | 3805088 | | 4/2021 |
| EP | 3808646 | | 4/2021 |
| EP | 1770007 | | 5/2021 |
| EP | 3692604 | A1 | 6/2021 |
| EP | 3842332 | | 6/2021 |
| EP | 3842333 | | 6/2021 |
| EP | 3889030 | A1 | 10/2021 |
| EP | 3889031 | A1 | 10/2021 |
| GB | 1173442 | | 12/1969 |
| GB | 2180374 | | 3/1987 |
| JP | 50090088 | A | 7/1975 |
| JP | S58061097 | | 4/1983 |
| JP | 59110298 | U | 7/1984 |
| JP | 60033710 | B | 8/1985 |
| JP | 61003200 | U | 1/1986 |
| JP | 62175296 | A | 7/1987 |
| JP | 62175298 | A | 7/1987 |
| JP | 63103797 | A | 5/1988 |
| JP | 63103798 | A | 5/1988 |
| JP | 63103800 | A | 5/1988 |
| JP | 01178099 | A | 7/1989 |
| JP | 01284906 | A | 11/1989 |
| JP | 01285486 | A | 11/1989 |
| JP | 04019296 | A | 1/1992 |
| JP | H04101206 | | 2/1992 |
| JP | 04310496 | A | 11/1992 |
| JP | H07223591 | | 8/1995 |
| JP | H07246998 | | 9/1995 |
| JP | 08056458 | A | 3/1996 |
| JP | 08056512 | A | 3/1996 |
| JP | 08056513 | A | 3/1996 |
| JP | 08058681 | A | 3/1996 |
| JP | 08127388 | A | 5/1996 |
| JP | 08187038 | A | 7/1996 |
| JP | 08266130 | A | 10/1996 |
| JP | 08266176 | A | 10/1996 |
| JP | 08276892 | A | 10/1996 |
| JP | 08276893 | A | 10/1996 |
| JP | 09048392 | A | 2/1997 |
| JP | 09048395 | A | 2/1997 |
| JP | 09048396 | A | 2/1997 |
| JP | 09052597 | A | 2/1997 |
| JP | 09109988 | A | 4/1997 |
| JP | 09142375 | A | 6/1997 |
| JP | 2926533 | | 7/1997 |
| JP | 09188293 | A | 7/1997 |
| JP | 09298929 | A | 11/1997 |
| JP | 09308352 | A | 12/1997 |
| JP | 10007090 | A | 1/1998 |
| JP | 10109689 | A | 4/1998 |
| JP | 11020780 | A | 1/1999 |
| JP | 2001146766 | A | 5/2001 |
| JP | 001206283 | A | 7/2001 |
| JP | 2002000038 | A | 1/2002 |
| JP | 3299664 | B2 | 7/2002 |
| JP | 3326055 | B2 | 9/2002 |
| JP | 3352847 | B2 | 12/2002 |
| JP | 3387699 | B2 | 3/2003 |
| JP | 3469978 | B2 | 11/2003 |
| JP | 3609902 | B2 | 1/2005 |
| JP | 3621374 | B2 | 2/2005 |
| JP | 3634007 | B2 | 3/2005 |
| JP | 2006159027 | A | 6/2006 |
| JP | 2007248336 | | 9/2007 |
| JP | 2007307967 | A | 11/2007 |
| JP | 4105827 | B2 | 6/2008 |
| JP | 4105828 | B2 | 6/2008 |
| JP | 2008221933 | A | 9/2008 |
| JP | 2009227035 | | 10/2009 |
| JP | 4421316 | B2 | 2/2010 |
| JP | 2010158965 | A | 7/2010 |
| JP | 4809794 | B2 | 11/2011 |
| JP | 4925950 | B2 | 5/2012 |
| JP | 5042906 | | 7/2012 |
| JP | 5189454 | B2 | 4/2013 |
| JP | 5213562 | B2 | 6/2013 |
| JP | 5226355 | | 7/2013 |
| JP | 5449510 | B2 | 3/2014 |
| JP | 5535373 | B2 | 7/2014 |

(56) References Cited

FOREIGN PATENT DOCUMENTS

| | | | |
|---|---|---|---|
| JP | 2015033857 | A | 2/2015 |
| JP | 2015033858 | A | 2/2015 |
| JP | 2015199372 | A | 11/2015 |
| JP | 2015199373 | A | 11/2015 |
| JP | 5885707 | B2 | 3/2016 |
| JP | 2016049903 | | 4/2016 |
| JP | 2016074250 | | 5/2016 |
| JP | 2016159805 | A | 9/2016 |
| JP | 2016216008 | A | 12/2016 |
| JP | 2017136932 | A | 8/2017 |
| JP | 2017178242 | | 10/2017 |
| JP | 2017185885 | A | 10/2017 |
| JP | 6405568 | B2 | 10/2018 |
| JP | 6447387 | B2 | 1/2019 |
| JP | WO2018179447 | A1 | 4/2019 |
| JP | 2020032871 | A | 3/2020 |
| JP | 6820274 | | 1/2021 |
| JP | 2021071800 | A | 5/2021 |
| JP | 2021084565 | A | 6/2021 |
| JP | 2021160373 | A | 10/2021 |
| KR | 20140011245 | | 1/2014 |
| SE | 540567 | | 10/2018 |
| WO | WO 1992005505 | | 4/1992 |
| WO | WO 1993005406 | | 3/1993 |
| WO | WO 2006040785 | | 4/2006 |
| WO | WO 2006058400 | | 6/2006 |
| WO | WO 2006062416 | | 6/2006 |
| WO | WO 2008066422 | | 6/2008 |
| WO | WO 2008111249 | | 8/2008 |
| WO | WO 2009113923 | | 9/2009 |
| WO | WO 2011099931 | | 8/2011 |
| WO | WO 2012010818 | | 1/2012 |
| WO | WO 2016091191 | A1 | 6/2016 |
| WO | WO 2016188963 | | 12/2016 |
| WO | WO 2016209767 | | 12/2016 |
| WO | WO 2017095235 | | 6/2017 |
| WO | WO 2017167905 | | 10/2017 |
| WO | WO 2017168234 | | 10/2017 |
| WO | WO 2017202468 | A1 | 11/2017 |
| WO | WO 2018162933 | | 9/2018 |
| WO | WO 2018179447 | A1 | 10/2018 |
| WO | WO 2018201097 | | 11/2018 |
| WO | WO 2018232376 | | 12/2018 |
| WO | WO 2018232377 | | 12/2018 |
| WO | WO 2019011451 | A1 | 1/2019 |
| WO | WO 2018179447 | A1 | 4/2019 |
| WO | WO 2019081019 | A1 | 5/2019 |
| WO | WO 2019096401 | | 5/2019 |
| WO | WO 2019126755 | | 6/2019 |
| WO | WO 2019157400 | | 8/2019 |
| WO | WO 2019201945 | | 10/2019 |
| WO | WO 2020069750 | A1 | 4/2020 |
| WO | WO 2020147967 | A1 | 7/2020 |
| WO | WO 2020238814 | A1 | 12/2020 |
| WO | WO 2020251552 | A1 | 12/2020 |
| WO | WO 2021058388 | A1 | 4/2021 |

OTHER PUBLICATIONS

Arbuckle et al., "System and Method for Controlling a Position of a Marine Vessel Near an Object," Unpublished U.S. Appl. No. 15/818,226, filed Nov. 20, 2017.

Arbuckle et al., "System and Method for Controlling a Position of a Marine Vessel Near an Object," Unpublished U.S. Appl. No. 15/818,233, filed Nov. 20, 2017.

John Bayless, Adaptive Control of Joystick Steering in Recreational Boats, Marquette University, Aug. 2017, https://epublications.marquette.edu/cgi/viewcontent.cgi?article=1439&context=theses_open.

Kirchoff, Unpublished U.S. Appl. No. 17/131,115, filed Dec. 22, 2020.

Kirchoff, Unpublished U.S. Appl. No. 17/185,289, filed Feb. 25, 2021.

Kraus, Unpublished U.S. Appl. No. 17/185,289, filed Feb. 25, 2021.

Mercury Marine, Axius Generation 2 Installation Manual, Jul. 2010, pp. 22-25.

Mercury Marine, Joystick Piloting for Outboards Operation Manual, 2013, pp. 24-26.

Mercury Marine, Zeus 3000 Series Pod Drive Models Operation Manual, 2013, pp. 49-52.

Poorman et al., "Multilayer Control System and Method for Controlling Movement of a Marine Vessel", Unpublished U.S. Appl. No. 11/965,583, filed Dec. 27, 2007.

Unpublished U.S. Appl. No. 16/535,946.

* cited by examiner

YAW WITH ONLY REAR DRIVES

LATERAL DRIVE DECREASES TOTAL YAW

YAW WITH ONLY LATERAL DRIVE

LATERAL DRIVE INCREASES TOTAL YAW

LATERAL DRIVE CANCELS YAW

LATERAL DRIVE CANCELS YAW

LATERAL DRIVE INCREASES TOTAL SWAY

LATERAL DRIVE DECREASES TOTAL SWAY

SWAY WITH REAR DRIVES

MARINE PROPULSION CONTROL SYSTEM AND METHOD WITH REAR AND LATERAL MARINE DRIVES

FIELD

The present disclosure generally relates to methods and systems for propelling marine vessels, and more particularly to systems and methods for providing lateral and rotational propulsion.

BACKGROUND

Many different types of marine drives are well known to those skilled in the art. For example, steerable marine drives mounted to the rear of the vessel, such as outboard motors that are attached to the transom of a marine vessel and stern drive systems that extend in a rearward direction from the stern of a marine vessel, may be provided in groups of two or more and separately steerable to enable surge, sway, and yaw directional control, sometimes referred to as joysticking. The steerable marine drives are each steerable about their steering axis to a range of steering angles, which is effectuated by a steering actuator. Lateral marine drives may be positioned to exert lateral force on the marine vessel, such as bow thrusters. Marine drives generally comprise a powerhead, such as an electric motor or an internal combustion engine, driving rotation of a drive shaft that is directly or indirectly connected to a propeller on a propeller shaft and that imparts rotation thereto.

The following U.S. Patents are incorporated herein by reference, in entirety:

U.S. Pat. No. 6,234,853 discloses a docking system that utilizes the marine propulsion unit of a marine vessel, under the control of an engine control unit that receives command signals from a joystick or push button device, to respond to a maneuver command from the marine operator. The docking system does not require additional marine drives other than those normally used to operate the marine vessel under normal conditions. The docking or maneuvering system of the present invention uses two marine propulsion units to respond to an operator's command signal and allows the operator to select forward or reverse commands in combination with clockwise or counterclockwise rotational commands either in combination with each other or alone.

U.S. Pat. No. 6,402,577 discloses a hydraulic steering system in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allows the extension of the steering arm to move relative to a moveable second portion of the steering actuator. The moveable second portion of the steering actuator moves linearly within a cylinder cavity formed in a first portion of the steering actuator.

U.S. Pat. No. 7,398,742 discloses a steering assist system providing differential thrusts by two or more marine drives in order to create a more effective turning moment on a marine vessel. The differential thrusts can be selected as a function of the magnitude of turn commanded by an operator of the marine vessel and, in addition, as a function of the speed of the marine vessel at the time when the turning command is received.

U.S. Pat. No. 7,467,595 discloses a method for controlling the movement of a marine vessel that rotates one of a pair of marine drives and controls the thrust magnitudes of two marine drives. A joystick is provided to allow the operator of the marine vessel to select port-starboard, forward-reverse, and rotational direction commands that are interpreted by a controller which then changes the angular position of at least one of a pair of marine drives relative to its steering axis.

U.S. Pat. No. 9,039,468 discloses a system that controls speed of a marine vessel that includes first and second marine drives that produce first and second thrusts to propel the marine vessel. A control circuit controls orientation of the marine drives between an aligned position in which the thrusts are parallel and an unaligned position in which the thrusts are non-parallel. A first user input device is moveable between a neutral position and a non-neutral detent position. When the first user input device is in the detent position and the marine drives are in the aligned position, the thrusts propel the marine vessel in a desired direction at a first speed. When a second user input device is actuated while the first user input device is in the detent position, the marine drives move into the unaligned position and propel the marine vessel in the desired direction at a second, decreased speed without altering the thrusts.

U.S. Pat. No. 10,259,555 discloses a method for controlling movement of a marine vessel near an object that includes accepting a signal representing a desired movement of the marine vessel from a joystick. A sensor senses a shortest distance between the object and the marine vessel and a direction of the object with respect to the marine vessel. A controller compares the desired movement of the marine vessel with the shortest distance and the direction. Based on the comparison, the controller selects whether to command the marine propulsion system to generate thrust to achieve the desired movement, or alternatively whether to command the marine propulsion system to generate thrust to achieve a modified movement that ensures the marine vessel maintains at least a predetermined range from the object. The marine propulsion system then generates thrust to achieve the desired movement or the modified movement, as commanded.

U.S. Pat. No. 10,926,855 discloses a method for controlling low-speed propulsion of a marine vessel powered by a marine propulsion system having a plurality of propulsion devices that includes receiving a signal indicating a position of a manually operable input device movable to indicate desired vessel movement within three degrees of freedom, and associating the position of the manually operable input device with a desired inertial velocity of the marine vessel. A steering position command and an engine command are then determined for each of the plurality of propulsion devices based on the desired inertial velocity and the propulsion system is controlled accordingly. An actual velocity of the marine vessel is measured and a difference between the desired inertial velocity and the actual velocity is determined, where the difference is used as feedback in subsequent steering position command and engine command determinations.

U.S. Pat. No. 11,091,243 discloses a propulsion system on a marine vessel that includes at least one steerable propulsion device and at least one lateral thruster. A steering wheel is mechanically connected to and operable by a user to steer the at least one propulsion device. A user interface device is operable by a user to provide at least a lateral thrust command to command lateral movement and a rotational thrust command to command rotational movement of the vessel. A controller is configured to determine a difference between a steering position of the propulsion device and a centered steering position. A user interface display is controllable to indicate at least one of the steering position of the propulsion device and the difference between the steering position and the centered steering position. The controller is further configured to determine that the steering position is within a threshold range of the centered steering position.

U.S. Publication No. 2021/0286362 discloses a marine propulsion system that includes at least two parallel propulsion devices that each generate forward and reverse thrusts, wherein the parallel propulsion devices are oriented such that their thrusts are parallel to one another, and at least one drive position sensor configured to sense a drive angle of the parallel propulsion devices. A lateral thruster is configured to generate starboard and port thrust to propel the marine vessel. A user input device is operable by a user to provide at least a lateral thrust command to command lateral movement of the marine vessel and a rotational thrust command to command rotational movement of the marine vessel. A controller is configured to control the parallel propulsion devices and the lateral thruster based on the lateral steering input and/or the rotational steering input and the drive angle so as to provide the lateral movement and/or the rotational movement commanded by the user without controlling the drive angle.

U.S. application Ser. No. 17/131,115 discloses a method of controlling an electric marine propulsion system configured to propel a marine vessel including measuring at least one parameter of an electric motor in the electric marine propulsion system and determining that the parameter measurement indicates an abnormality in the electric marine propulsion system. A reduced operation limit is then determined based on the at least one parameter measurement, wherein the reduced operation limit includes at least one of a torque limit, an RPM limit, a current limit, and a power limit. The electric motor is then controlled such that the reduced operation limit is not exceeded.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one aspect, a marine propulsion system configured for propelling a marine vessel includes at least two steerable rear marine drives that each generate forward and reverse thrusts, wherein each rear marine drive is independently steerable to a range of steering angles, and a lateral marine drive configured to generate starboard and port thrusts on the marine vessel. The system further includes a user input device, such as a joystick, operable by a user to provide a propulsion demand input commanding sway movement of the marine vessel and yaw movement of the marine vessel. A control system is included that is configured to control steering and thrust of each of the at least two rear marine drives and thrust of the lateral marine drive based on the propulsion demand input to generate the sway movement and/or the yaw movement commanded by the user.

In one embodiment, the lateral marine drive is positioned at a bow region of the marine vessel and is one of a discreet drive that operates only at a predetermined rotational speed and a variable speed drive where the rotational speed is controllable by the control system. In a further example, the lateral marine drive is a thruster and each of the rear marine drives is positioned to extend rearward of a stern of a marine vessel and includes an engine or an electric motor powering rotation of a propulsor.

In one embodiment, the control system is configured to operate both the lateral marine drive and the at least two rear marine drives when the propulsion demand input is within a high yaw demand range and/or a high sway demand range such that the lateral marine drive produces a thrust additive to a yaw and/or sway component of a total thrust of the at least two rear marine drives to achieve a greater yaw or sway velocity and/or a greater yaw or sway acceleration than is achievable with the at least two rear marine drives alone or with the lateral marine drive alone.

In one embodiment the control system is configured to operate both the lateral marine drive and the at least two rear marine drives when the propulsion demand input is within a lowest yaw demand range and/or a lowest sway demand range such that the lateral marine drive produces a thrust that opposes a yaw and/or a sway component of a total thrust of the at least two rear marine drives to achieve a lower yaw or sway velocity and/or a lower yaw or sway acceleration then is achievable with the at least two rear marine drives or with the lateral marine drive alone.

In one embodiment the control system is configured to operate only the lateral marine drive to generate yaw thrust when the propulsion demand input is within a mid-yaw demand range.

In one embodiment, the control system is configured to operate only the at least two rear marine drives to generate sway thrust when the propulsion demand input is within a mid-sway demand range.

In one embodiment, the user input device is configured to be operated in a first mode to control only the at least two rear marine drives, a second mode to control both the lateral marine drive and the at least two rear marine drives and a third mode to control only the lateral marine drive, and the control system is configured to receive user selection of the second mode prior to controlling steering and thrust of each of the at least two rear marine drives and thrust of the lateral marine drive based on the propulsion demand input.

In one embodiment, the system further comprises a control model stored in memory accessible by the control system, the control model representing hull characteristics and propulsion system characteristics for the marine vessel, wherein the control system is configured to utilize the control model to determine a thrust command for the lateral marine drive and a thrust command for each of the at least two rear marine drives. In a further example, the control system is configured to associate the propulsion demand input with a target velocity and/or a target acceleration and to utilize the control model to solve for at least one of a surge command, a sway command, and a yaw command for each of the lateral marine drive and the at least two rear marine drives based on the target velocity and/or target acceleration.

In another further example, the control model is based on at least a vessel length of the marine vessel, a vessel beam of the marine vessel, a location of each marine drive, a thrust capability of each marine drive, and the range of steering angles for each rear marine drive.

In one embodiment the control system is further configured to determine a thrust command for each of the lateral marine drive and the at least two rear marine drives and a steering position command for each of the at least two rear marine drives based on the propulsion demand input, a number of marine drives operating in the propulsion system, and a location of each of at least the lateral marine drive and the at least two rear marine drives with respect to a center of turn of the marine vessel.

In a further embodiment, the control system is configured to determine the thrust commands based on a charge level of a power storage device associated with at least one of the lateral marine drives and the at least two rear marine drives.

In one embodiment, the system further comprises a map stored in memory by the control system, wherein the map is configured to correlate the possible propulsion demand inputs from the user input device to thrust commands for each of the lateral marine drive and each of the at least two marine drives. The control system is configured to utilize the map to determine a thrust command for the lateral marine drive and thrust commands for each of the at least two rear marine drives based on the propulsion demand input.

In a further embodiment, the map is configured to correlate a charge level of a battery associated with at least one of the lateral marine drives and at least two rear marine drives to thrust commands for each of the lateral marine drive and each of the at least two rear marine drives.

A method of controlling a marine propulsion system for a marine vessel includes receiving from a user input device a propulsion demand input commanding a sway movement of the marine vessel and/or a yaw movement of the marine vessel. The method further includes determining a rear thrust command and a steering position command for each of at least two steerable rear marine drives based on the propulsion demand input, where each rear marine drive generates forward and reverse thrusts and is independently steerable to a range of steering angles, and determining a lateral thrust command based on the propulsion demand input for a lateral marine drive configured to generate starboard and port thrusts on the marine vessel. Each of the at least two rear marine drives are then controlled based on the respective rear thrust command and the respective steering position command, and the lateral marine drive is controlled based on the lateral thrust command so as to generate the sway movement and/or the yaw movement commanded by the user.

In one embodiment, the rear thrust commands and the steering position commands for the at least two rear marine drives and the lateral thrust command for the lateral marine drive is based on the propulsion demand input, a number of marine drives operating in the propulsion system, and a location of each of at least the lateral marine drive and the at least two rear marine drives with respect to a center of turn of the marine vessel.

In a further example, the rear thrust commands and the steering position commands for the at least two rear marine drives and the lateral thrust command for the lateral marine drive is further based on a charge level of a battery associated with at least one of the lateral marine drives and the at least two rear marine drives.

In one embodiment, when the propulsion demand input is within a lowest yaw demand range and/or a lowest sway demand range, the lateral marine drive is controlled to produce a thrust that opposes a yaw and/or sway component of a total thrust of the at least two rear marine drives to achieve a lower yaw or sway velocity and/or a lower yaw or sway acceleration than is achievable with the at least two rear marine drives along or with the lateral marine drive alone.

In one embodiment, when the propulsion demand input is within a high yaw demand range and/or a high sway demand range, the lateral marine drive is controlled to produce a thrust that is additive to a yaw and/or sway component of a total thrust of the at least two rear marine drives to achieve a greater yaw or sway velocity and/or greater yaw or sway acceleration than is achievable with the at least two rear marine drives alone or the lateral marine drive alone.

In one embodiment, only the lateral marine drive is operated to generate yaw thrust when the propulsion demand input is within a mid yaw demand range.

In one embodiment, only the at least two rear marine drives are operated to generate sway thrust when the propulsion demand input is within a mid sway demand range.

In one embodiment, the method further includes storing a control model representing hull characteristics and propulsion system characteristics and utilizing the control model to determine each of the rear thrust commands and the lateral thrust command.

In one embodiment, the step of determining the lateral thrust command includes utilizing a closed-loop yaw controller to determine the lateral thrust command based at least in part on sensed yaw motion of the marine vessel. In a further example, where the received propulsion demand input commands zero yaw movement, a magnitude and a direction of the lateral thrust command is determined based on the sensed yaw motion to generate an opposing yaw thrust.

In one embodiment, the method further includes storing a map configured to correlate all possible propulsion demand inputs from the user input device to thrust commands for each of the lateral marine drive and each of the at least two rear marine drives, and utilizing the map to determine the lateral thrust command for the lateral marine drive and the rear thrust command for each of the at least two rear marine drives.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Figure 1:
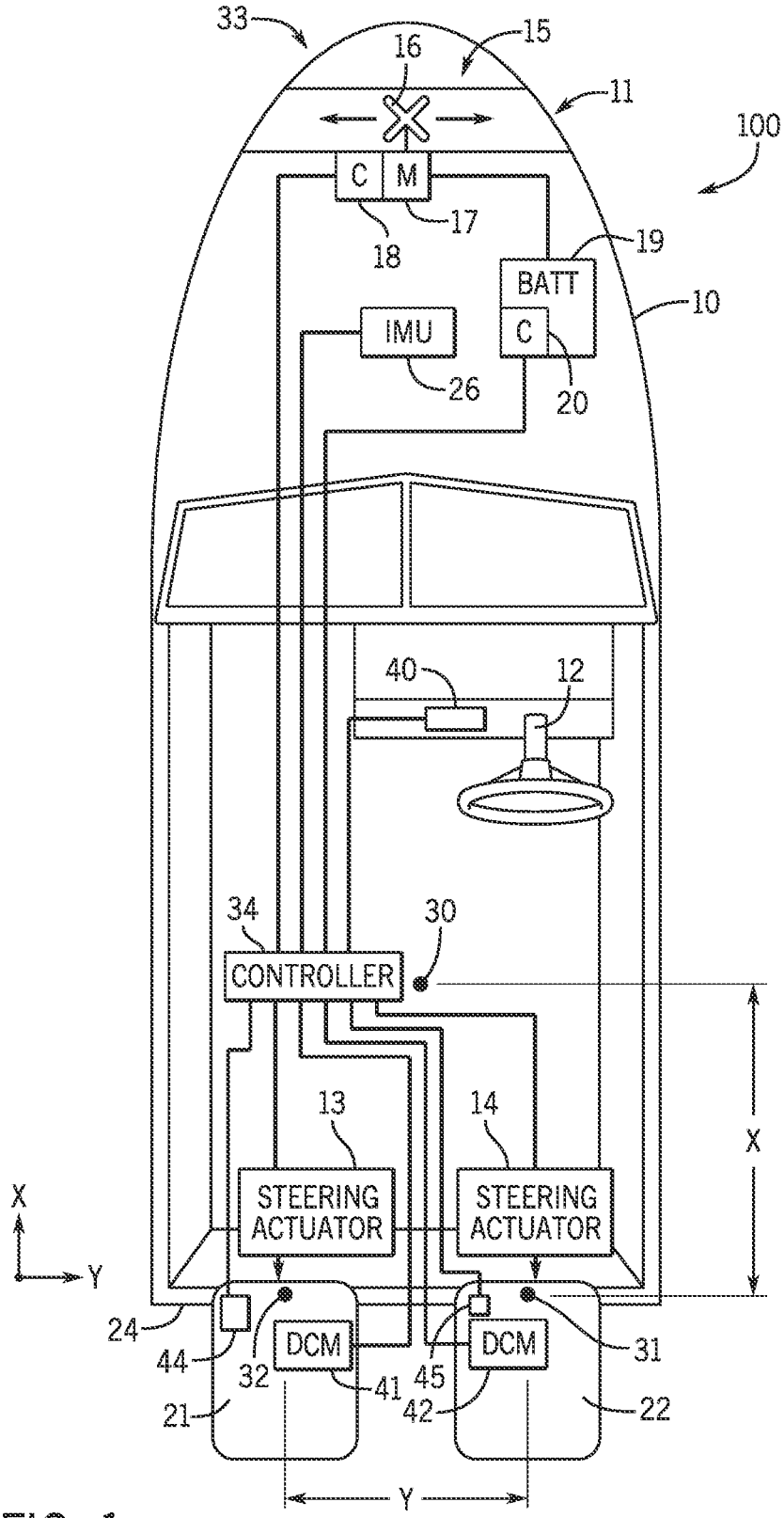
FIG. 1 is a schematic illustration of a marine vessel with one embodiment of a propulsion system according to the present disclosure.

The inventors have recognized a need for vessel control systems and methods that provide improved control over lateral and rotational movement of the marine vessel. Rear drives are increasingly mounted closer together on the stern of the vessel to optimize on-plane performance. Placing the drives close together negatively impacts the capabilities of the propulsion system to effectuate and control sideways lateral (sway) and rotational (yaw) propulsion, thus negatively impacting performance of the propulsion system for joysticking. For example, mounting the drives closer to the centerline of the vessel narrows the steering angle utilized to effectuate sway movements—i.e., reducing the drive splay when moving the vessel laterally sideways. Decreased steering angles reduces the sway components of thrust and the resulting sway vector and decreasing efficiency. Drives close to center are also less efficient at generating yaw movements. Additionally, joysticking with only rear drives requires frequent gear shifting and steering changes for each of the plurality of rear drives, which tends to generate significant noise and impart potentially uncomfortable vibrations on the vessel.

Based on the foregoing problems and challenges in the relevant art, the inventors developed the disclosed propulsion systems and methods providing integrated control of both rear and lateral marine drives to unify thrust calculations and optimize efficiency of lateral and rear drives on the vessel. In addition to a plurality of independently steerable rear-marine drives positioned at the stern of the marine vessel, one or more lateral marine drives is positioned and configured to generate starboard and port thrusts on the side of vessel. The system is configured to control steering and thrust of each of the plurality of rear marine drives and to control thrust of a lateral marine drive based on a user-provided propulsion demand input. Thus, the propulsion system is configured to optimize the starboard and port thrusts from the lateral thruster in conjunction with the rear thrusts from the steerable rear drives to most efficiently and effectively generate sway movement and/or yaw movement commanded by the user.

The lateral marine drive may be mounted in an area of the bow of the marine vessel and controllable in forward and reverse directions to generate starboard and port directional thrusts at the bow. The starboard and port thrusts, including the yaw moment of the lateral marine drive thrust, is integrated into and accounted for in the propulsion control scheme such that the thrusts generated by the lateral marine drive and the plurality of rear marine drives are totaled and each individual drive is controlled so that the total sway thrust effectuated by all drives in the propulsion system results in the commanded lateral sway movement and/or surge movement and the total yaw thrust effectuated by all drives in the propulsion system results in the commanded rotational yaw movement (or lack thereof).

The control system and method are configured to operate the lateral marine drive, the plurality of real marine drives, or both simultaneously depending on the propulsion demand input. For example, when the propulsion demand input is within a high yaw demand range and/or a high sway demand range, and thus large yaw and/or sway acceleration is demanded, both the lateral marine drive and the at least two rear marine drives are operated in an additive way to increase the yaw and/or lateral component of the total thrust produced. The lateral thrust produced by the lateral marine drive is coincident with the yaw and/or sway component of the total thrust from the rear drives to achieve a greater yaw or sway velocity and/or a greater yaw or sway acceleration than would be achievable with just the rear marine drives alone or just the lateral marine drive alone.

Conversely, the lateral marine drive may be controlled to produce a lateral thrust that opposes a yaw and/or lateral component of a total thrust of the at least two rear marine drives to achieve a lower sway velocity and/or a lower yaw velocity than is achievable with the rear marine drives alone or with the lateral marine drive alone. Thus, when the propulsion demand input is within a lowest yaw demand range and/or a lowest sway demand range, and thus slow and precise vessel movements are demanded, the lateral marine drive can be operated to produce an opposite yaw or sway a portion of the yaw or sway thrust generated by the plurality of rear marine drives so as to slow the yaw or sway movement of the vessel. In an example where the lateral marine drive is an electric drive, such as variable speed thruster, thrust magnitude and direction generated by the lateral marine drive can be quickly and precisely controlled to fine-tune the total yaw or sway thrust effectuated by the propulsion system. This may also lessen the shifting and steering changes required from the rear drives, thereby yielding smoother, quieter, and more responsive joysticking experience. Additionally, the lateral marine drive, such as a later thruster, may be used to efficiently counteract any unwanted yaw that may occur when effectuated a commanded surge motion, such as when moving the vessel in reverse to back into a slip or other docking location.

In certain yaw and/or sway demand ranges, the control system may be configured to operate only the lateral marine drive or only the plurality of rear marine drives to generate the commanded thrust. For example, the control system may be configured to operate only the lateral marine drive to generate yaw thrust when the propulsion demand input is within a low yaw demand range. As mentioned above, utilization of the lateral marine drive only to control the yaw thrust may have the benefit of reducing the shifting and steering activity of the rear marine drives, thus providing a more comfortable ride for the user along with precise yaw control. The control system may be configured to operate only the plurality of rear marine drives to generate thrust when the propulsion demand input is within a mid-yaw demand range and/or a mid-sway demand range. Where the lateral marine drive is an electric drive and the rear marine drives are combustion-powered drives, controlling at least a portion of the thrust range using only the plurality of rear marine drives may be effectuated to conserve battery power utilized by the lateral marine drive.

FIG. 1 is a schematic representation of a marine vessel 2 equipped with propulsion system 100 including two rear marine drives 21 and 22 positioned at the stern 24, such as attached to the transom. The number of marine drives is exemplary and a person having ordinary skill in the art will understand in light of the present disclosure that any number of two or more marine drives may be utilized in the disclosed system and method. Each rear marine drive 21, 22 is individually and separately steerable, each having a respective steering actuator 13, 14 configured to rotate the drive 21, 22 about its respective steering axis 31, 32. The steering axes 31 and 32 are separated by a dimension Y and at a distance X from the center of turn 30 (COT), which could also be the effective center of gravity (COG). The marine vessel 10 is maneuvered by causing the first and second marine drives to rotate about their respective steering axis 31 and 32. The rear marine drives 21 and 22 are rotated in response to an operator's manipulation of the steering wheel 12 or user input device 40, which is communicatively connected to the steering actuators 13, 14, which rotate the marine drives 21 and 22. Rotating the rear marine drives 21 and 22 and effectuating thrusts thereby cause rotation of the marine vessel 10 about the effective COT 30.

The propulsion system 100 further includes a lateral marine drive 15 configured to effectuate lateral thrust on the vessel 10 in the starboard and port directions. In the depicted example, the lateral marine drive 15 is an electric drive positioned at a bow region 11 of the vessel 10 configured to effectuate lateral thrust at the bow, which may also be referred to a bow thruster positioned. Bow thrusters are known to those skilled in the art, as are other types and locations of marine drive arrangements configured to only effectuate lateral thrusts on the vessel 10, which may be placed at other locations on the vessel 10 besides the bow 11. The lateral marine drive 15 may be a discrete drive, or discrete thruster, that operates only at a predetermined RPM and thus is only controllable by turning on and off the drive. Alternatively, the lateral marine drive 15 may be a proportional drive, or proportional thruster, wherein the rotational speed (e.g., rotations per minute RPM) is controllable by the control system 33 between a minimum RPM and a maximum RPM that the drive is rated to provide. A person having ordinary skill in the art will understand in view of the present disclosure that the disclosed propulsion system 100 may include other types and locations of lateral marine drives 15, which may be an alternative to or in addition to a lateral drive positioned at the bow.

The lateral marine drive 15 includes a propeller 16, sometime referred to as a fan, that is rotated by a bi-directional motor 17 in forward or reverse direction to effectuate lateral thrust in the starboard and port directions. The controller 34 may be communicatively connected to a drive controller 18 for the lateral marine drive 15 to control activation and direction of thrust by the lateral marine drive 15. Where the lateral drive 15 is configured as a discrete drive, the controller 18 provides on/off and directional control of the motor 17, and thus rotate in the clockwise and counterclockwise directions at a single speed. In other embodiments, the lateral marine drive 15 is a variable speed drive, wherein the motor 17 is controllable to rotate the propeller 16 at two or more speeds. For example, the motor 17 may be a brushless DC motor configured for variable multi-speed control of the propeller 16 in both the clockwise and counterclockwise rotation directions.

Where one or more of the marine drives 15, 21, 22 is an electric drive—i.e., have a powerhead being an electric motor—the propulsion system 100 will include a power storage device 19 powering the motor(s) thereof. The power storage device, such as a battery or bank of batteries, stores energy for powering the electric motor(s) (e.g., motor 17) and is rechargeable, such as by connection to shore power when the electric motor is not in use or by an on-board alternator system drawing energy from engine-driven marine drives (if any) on the marine vessel. The power storage device 19 may include a battery controller 20 configured to monitor and/or control aspects of the power storage device 19. For example, the battery controller 20 may receive inputs from one or more sensors within the power storage device 19, such as a temperature sensor configured to sense a temperature within a housing of the power storage device where one or more batteries or other storage elements are located. The battery controller 20 may further be configured to receive information from current, voltage, and/or other sensors within the power storage device 19, such as to receive information about the voltage, current, and temperature of each battery cell within the power storage device 19. In addition to the temperature of the power storage device, the battery controller 20 may be configured to determine and communicate a charge level to the central controller 34 and/or other controller within the control system 33. The charge level may include one or more of, for example, a voltage level of the power storage device, a state of charge of the power storage device 19, a state of health of the power storage device 19, etc.

Figure 2A:
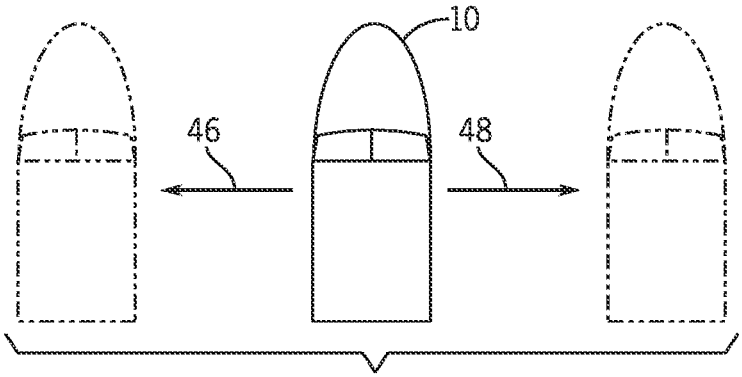
FIGS. 2A-2E are schematic illustrations of various movements of a marine vessel.
Figure 2B:
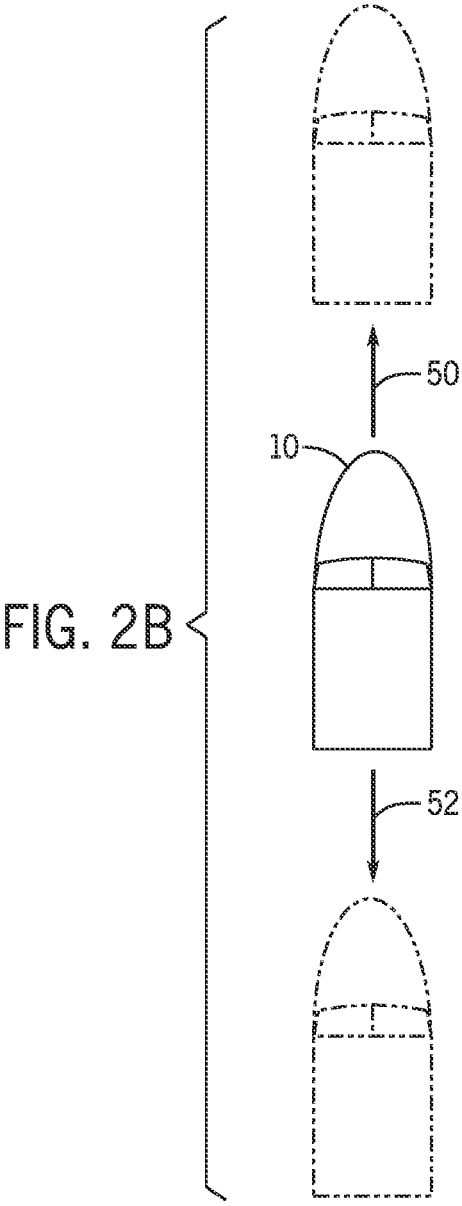
Figure 2C:
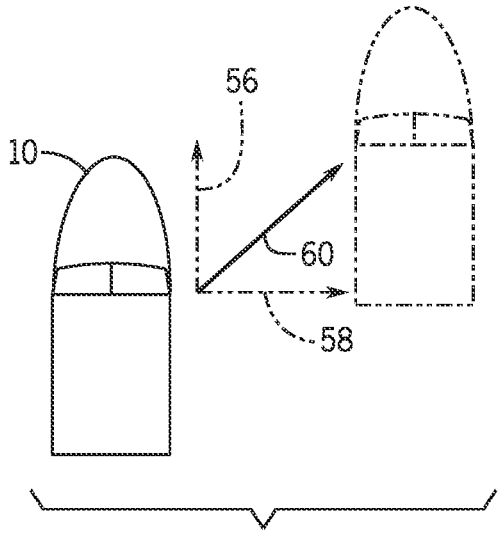
Figure 2D:
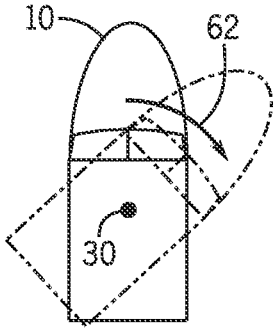
Figure 2E:
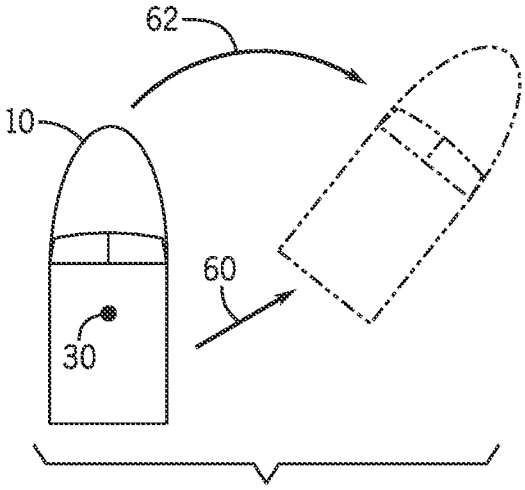

The propulsion system 100 further includes a user input device 40, such as a joystick or a keypad, operable by a user to provide at least a lateral movement demand input and rotational movement demand input. The user input device enables a user to give a lateral propulsion demand commanding sway movement of the marine vessel, or longitudinal movement along the y-axis, without requiring surge movement along the x-axis. The user input device also enables a user to give a rotational propulsion demand input commanding rotational movement of the marine vessel 10 about the COT 30 without lateral or surge movements. FIGS. 2A-2E illustrate exemplary vessel movements that may be commanded via the user input device 40. FIG. 2A shows the vessel 10 moving laterally, or sway movement, in the port direction 46 and the starboard direction 48 without any forward or reverse motion and without any rotation about its COT 30. FIG. 2B shows the vessel 10 moving in the forward 50 direction and backward 52 direction, also known as surge movement. FIG. 2C shows a combination of forward surge and starboard sway motions of the vessel 10, where the surge movement is represented by the dashed arrow 56 and the sway movement is represented by the dashed arrow 58. The resultant motion vector 60 moves the vessel in the forward and starboard directions without any rotation. FIG. 2D illustrates a clockwise rotation 62, or yaw movement, of the marine vessel 10 about the COT 30 without any translation movement, including any surge movement or sway movement. FIG. 2E illustrates a combination of yaw movement, represented by arrow 62, and surge and sway translation in the forward and starboard directions, represented by arrow 60.

The disclosed system and method enable lateral and rotational movement of the marine vessel, such as that illustrated in FIGS. 2A-2E, by effectuating steering and thrust control of the marine drives 21 and 22 and thrust control of the lateral marine drive 15. By effectuating a forward thrust by one of the rear marine drives 21 or 22 and a reverse thrust by the other, the coupled forces will impart a torque about the COT 30. The torque imparted will depend on the magnitude and steering angle of each rear marine drive. The basic vector calculations involved in joystick control are known in the relevant art. If the drive angle of the marine drives is known, then vector analysis can be performed to effectuate any rotational movement and, in an embodiment incorporating a lateral marine drive 15, lateral movement in the port direction 46 and the starboard direction 48, as well as forward direction 50 and reverse direction 52 movement. The system 100 is configured to provide translational movement in other translational directions combining forward/reverse and port/starboard thrusts of the rear and lateral drives 21-22 and 15.

The user steering inputs provided at the user input device 40 are received by the control system 33, which may include multiple control devices communicatively connected via a communication link, such as a CAN bus (e.g., a CAN Kingdom Network), to control the propulsion system 100 as described herein. In the embodiment of FIG. 1, the control system 33 includes a central controller 34 communicatively connected to the drive control module (DCM) 41 and 42 of each rear marine drive 21 and 22, respectively, the DCM 18 of the lateral marine drive 15, and may also include other control devices such as the battery controller 20. Thereby, the controller 34 can communicate instructions to each DCM 41 and 42 of the rear drives to effectuate a commanded magnitude of thrust and a commanded direction of thrust (forward or reverse), as is necessary to effectuate the lateral and/or rotational steering inputs commanded at the user input device 40. The controller also communicates a steering position command to each steering actuator 13 and 14 to separately steer each marine drive 21, 22. Drive position sensors 44 and 45 are configured to sense the steering angle, or steering position, of the drives 21 and 22, respectively. The central controller 34 also communicates a command instruction to the DCM 18 for the lateral marine drive, wherein the commands are coordinated such that the total of the thrusts from the rear and lateral marine drives yields the user's propulsion demand input. A person of ordinary skill in the art will understand in view of the present disclosure that other control arrangements could be implemented and are within the scope of the present disclosure, and that the control functions described herein may be combined into a single controller or divided into any number of a plurality of distributed controllers that are communicatively connected.

Figure 3:
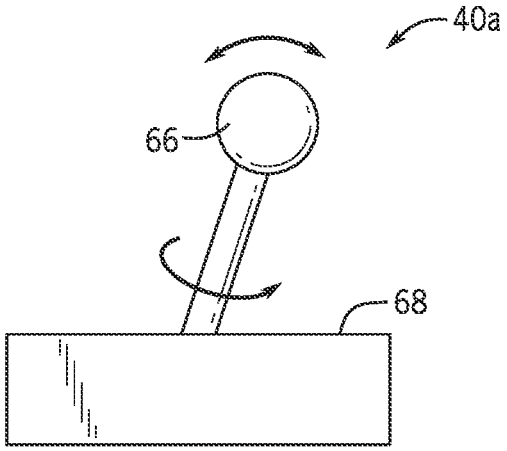
FIG. 3 illustrates an exemplary joystick user input device.
Figure 4:
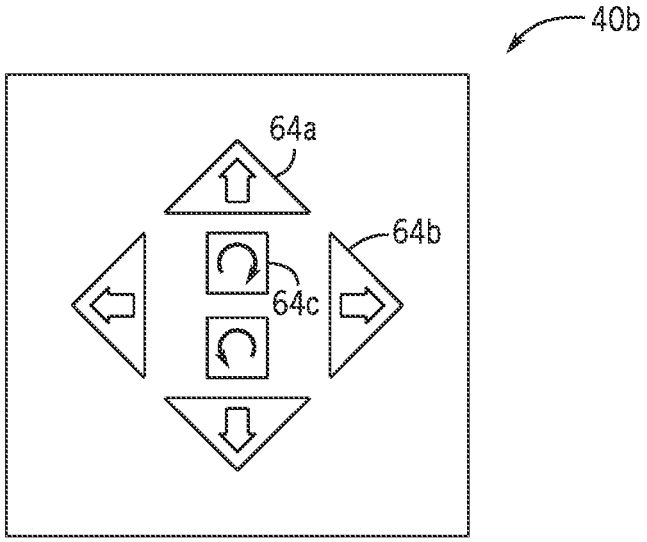
FIG. 4 illustrates an exemplary keypad user input device.

FIGS. 3 and 4 exemplify two possible types of user input devices 40. FIG. 3 depicts a well-known joystick device that comprises a base 68 and a moveable handle 66 suitable for movement by an operator. Typically, the handle can be moved left and right, forward and back, as well as rotated relative to the base 68 to provide corresponding movement commands for the propulsion system. FIG. 4 depicts an alternative user input device 40*b* being a keypad with buttons 64 associated with each of the right, left, forward, backward, and rotational movement directions. Thus, a forward button 64*a* can be pressed by a user to provide a forward thrust command to move the marine vessel forward and key 64*b* can be pressed by a user to input a lateral thrust command to command lateral movement of the marine vessel 10. Similarly, the clockwise rotation key 64*c* can be pressed by a user to input a clockwise rotational thrust command to command clockwise rotational movement of the marine vessel 10. The other keys on the keypad 40*b* operate similarly. The joystick 40*a* and keypad 40*b* are merely exemplary, and other types of user input devices enabling a user to command lateral and rotational movement are within the scope of the present disclosure.

In certain embodiments, the user input device 40 may be operable in multiple modes selectable by a user. For example, the user input device 40 may be operable in a first mode to control only the rear marine drives, such as for joysticking using only the rear marine drives. The user input device 40 may be operable in a second mode to control both the lateral marine drive 15 and the rear marine drives 21, 22 in conjunction, such as according to one or more of the embodiments described herein. Alternatively or additionally, the user input device 40 may be operable in a third mode to control only the lateral marine drive 15, such as where the rear marine drives are controlled by a separate user input device. For example, the propulsion system 100 may be configured such that the user can select an operation mode for the user input device 40, for example via buttons or other user interface elements on the joystick or elsewhere at the helm. Alternatively or additionally, the system 100 may be configured to automatically select one or more of the operation modes based on engagement of various user input devices. To provide one example, the controller 34 may automatically engage the third control mode if the joystick (or other multi-directional user interface device 40) is engaged and one or more helm levers (e.g., throttle/shift levers) associated with the rear marine drives 21, 22 are being operated to control the drives 21, 22. There, control of the rear marine drives 21, 22 will be provided by the helm levers and the user input device 40, such as the joystick, will control only the lateral marine drive 15 (and/or any other lateral drives included within the propulsion system 100).

Where the user input device 40 is configured to operate in multiple modes, the control system 33 is configured to require user selection of the above-described second mode before employing the control methods described herein. Such user selection may be provided by selecting the above-described operation mode input element, such as a mode selection button on the joystick or a touch screen at the helm. For example, the second mode may be selectable by selecting engagement of a "docking mode", such as via a "docking mode" selection button on the user interface 40 or a touch screen at the helm. Alternatively, such user selection may be provided by selective engagement and disengagement of various user input elements at the helm. For example, the second mode may be selectable by engaging the user interface 40, such as the joystick or touchpad, and disengaging all other helm thrust control elements for the marine drives, such as putting all throttle/shift levers in neutral or otherwise deactivating the steering and/or thrust control functions.

The disclosed propulsion system 100 enables joystick control, or control by another user input device operable to provide lateral and rotational thrust control, of both the rear and lateral marine drives simultaneously and automatically such that the drives operate to provide precise and seamless sway and yaw control of the vessel 10. FIGS. 5A-5F exemplify integrated control of lateral and rear marine drives, illustrating force coupling between the plurality of rear marine drives 21 and 22 and the lateral marine drive 15 to effectuate commanded yaw movement of the vessel 10 and/or to cancel yaw movement of the vessel 10 that is not commanded. To effectuate only yaw movement, and thus to turn the vessel about its COT 30 without causing surge or sway movements, the control system 33 may utilize only the rear marine drives 21 and 22 generating opposite forward and reverse thrusts, or may utilize the lateral drive 15 and the plurality of rear drives to generate the total commanded yaw thrust.

The controller 34 may be configured to utilize yaw rate, such as from an inertial measurement unit (IMU) 26 or other rotational sensor capable of measuring yaw of the marine vessel 10, as the basis for controlling thrust magnitude and direction. The sensed yaw rate can be used as feedback control for adjusting the thrust commands. Namely, the controller 34 may determine an expected yaw rate, or yaw velocity, associated with the lateral and/or rotational thrust command from the user input device 40 and may compare the measured yaw rate from the IMU 26 to the expected yaw rate and adjust the thrust commands to reduce the difference between the measured yaw rate and the expected yaw rate.

Figure 5A:
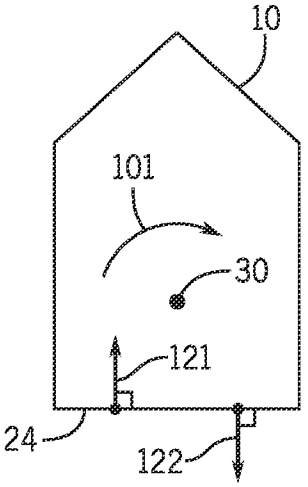
FIGS. 5A-5D depict combinations of thrust vectors by the exemplary propulsion system of FIG. 1 to effectuate exemplary yaw movements of the vessel.

FIG. 5A illustrates an example where yaw thrust is effectuated using only the rear marine drives 21 and 22. Both marine drives are steered to a centered drive angle such that the thrusts effectuated are perpendicular to the stern 24 or transom. The first marine drive 21 is controlled to effectuate a forward thrust, represented by vector 121. The second marine drive 22 is operated in the opposite direction to effectuate a backward thrust, represented by vector 122. The forward and reverse surge components of the thrusts cancel each other out, resulting in only a total yaw thrust in the clockwise direction about the center of turn 30, shown by arrow 101.

Figure 5B:
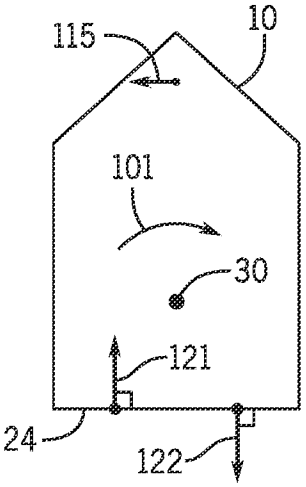

FIG. 5B illustrates the addition of the lateral drive thrust, vector 115, to decrease the total yaw thrust on the marine vessel by counteracting a portion of the total yaw thrust from the rear marine drives 21 and 22. For example, each of the lateral marine drive and the plurality of rear marine drives may have a minimum thrust that it can effectuate, meaning that there is a minimum yaw rate that can be generated by using only the lateral marine drive 15 or only the plurality of rear marine drives 21 and 22, alone. In certain embodiments, the minimum thrust for the lateral marine drive 15 may be different than that for each of the plurality of rear marine drives 21 and 22. For example, the lateral marine drive may be a smaller drive, and thus may have a lower minimum thrust capability. The lateral marine drive may be an electric drive and the rear marine drives 21 and 22 may be combustion-powered drives, and thus the lateral marine drive 15 may have a lower minimum thrust output capability than each of the rear marine drives 21 and 22. By operating the lateral marine drive 15 in opposition to the total yaw thrust from the rear marine drives 21 and 22, a lower total yaw thrust 101 and resulting yaw velocity is achievable than is possible with the rear drives 21 and 22 alone or the lateral drive 15 alone.

FIG. 5B builds on the example in FIG. 5A, where the rear marine drives 21 and 22 are operated to generate forward thrust vector 121 and reverse thrust vector 122, respectively, resulting in a clockwise yaw thrust. The yaw thrust generated by the rear drives 21 and 22 is counteracted by an opposing thrust from the lateral marine drive 15. Specifically, the lateral marine drive 15 is operated to generate a thrust forcing the bow in the port direction and thus effectuating a counterclockwise yaw moment about the center of turn 30. The yaw moment generated by the lateral marine drive thrust vector 115 opposes the yaw thrust generated by the rear marine drives 21 and 22, thus decreasing the total yaw thrust.

Figure 5C:
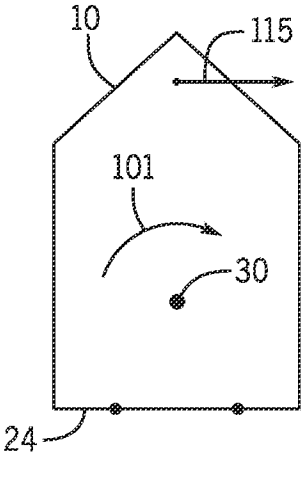

FIG. 5C illustrates an example where yaw motion is generated only utilizing the lateral marine drive 15. It is noted that in the exemplified configuration, the lateral marine drive 15 will also exert a sway thrust component on the vessel 10, and thus operating only the lateral marine drive to generate the yaw motion may also result in effectuating a sway motion if the rear marine drives are not activated to counteract the sway. Where the lateral marine drive 15 is operated to effectuate a starboard direction thrust on the bow region 11, a clockwise total yaw thrust 101 about the COT is generated.

Depending on the types and thrust capabilities of the various marine drives 15, 21, 22, on the vessel 10, it may be preferable to meet a commanded yaw thrust utilizing only the lateral marine drive 15. For example, where the rear marine drives 21 and 22 are configured for high thrust output, it may be preferable to utilize only the lateral marine drive 15 when the propulsion demand input is within a low yaw demand range, which may be at or below the minimum thrust capabilities of the rear marine drives 21 and 22 and/or may yield smoother and more comfortable operation for the user by minimizing shifting of the rear marine drives.

Figure 5D:
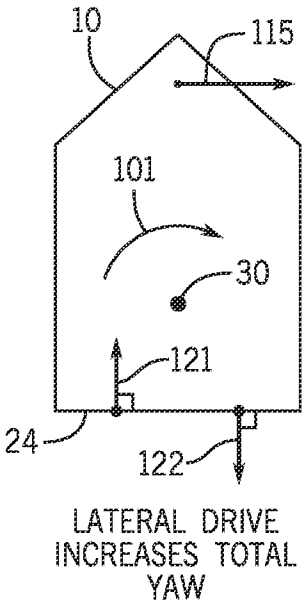

Operating the lateral marine drive in concert with the rear marine drives can yield a greater total yaw velocity when the thrust generated by all of the marine drives are additive. FIG. 5D illustrates one example where the lateral marine drive 15 is operated to generate a thrust that is additive to the total yaw thrust generated by the rear marine drives 21 and 22. Namely, the starboard direction thrust on the bow, represented by vector 115, adds to the forward and reverse thrust vectors 121 and 122 to effectuate an even larger yaw force about the COT 30, represented by arrow 101. Thereby, the yaw acceleration is increased and the total possible yaw velocity is also increased beyond that achievable with only the rear marine drives 21 and 22 or only the lateral marine drive 15.

Figure 5E:
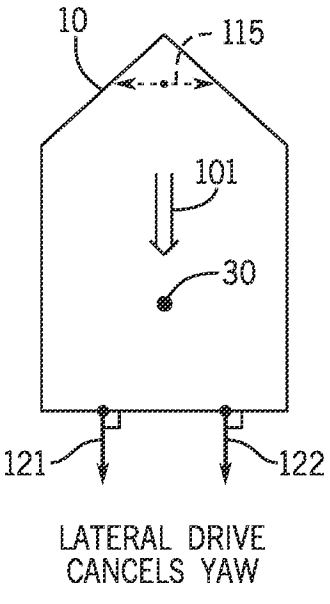
FIGS. 5E-5F depict combinations of thrust vectors by the exemplary propulsion system of FIG. 1 to cancel yaw when effectuating exemplary surge movements of the vessel.
Figure 5F:
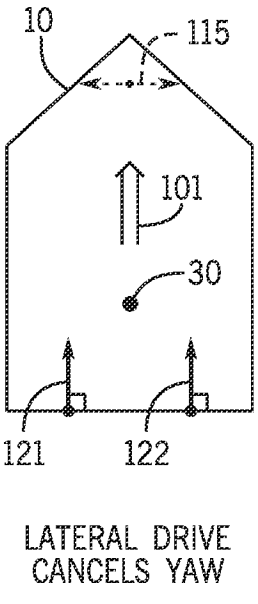

FIGS. 5E and 5F illustrate examples where surge thrust is effectuated with the rear marine drives 21 and 22 and the lateral drive 15 is operated to cancel any unwanted yaw, such as to enable the marine vessel to travel straight backward or straight forward. The inventors have recognized that straight forward or backward motion is sometimes difficult to achieve with only the rear drives because there are often asymmetrical forces on the starboard and port sides of the hull, such as due to wind, waves, and current. This may be a particular issue when moving the vessel in reverse, where the wide and typically flat stern may amplify the effects of asymmetrical forces on the vessel from water and wind. Thus, the disclosed system is configured to selectively utilize the at least one lateral marine drive 15 to counteract any uncommanded yaw motion that may occur during a surge motion of the vessel 10, such as to enable the marine vessel to travel straight forward and/or straight backward.

In FIG. 5E, the rear marine drives 21 and 22 are both controlled to effectuate equal rearward thrusts 121 and 122, both steered to a centered drive angle such that the thrusts effectuated are perpendicular to the stern 24, to move the vessel straight backward as indicated by arrow 101. In FIG. 5F, the rear marine drives 21 and 22 are both controlled to effectuate equal forward thrusts 121 and 122, both steered to a centered drive angle such that the thrusts effectuated are perpendicular to the stern 24, to move the vessel straight forward. In both the rearward and forward motion examples, the lateral marine drive 15 is controlled to counteract any yaw motion of the vessel 10 that might occur, and thus may be actuated in either the forward or reverse rotational directions to effectuate starboard or port lateral thrusts 115 depending on which unwanted yaw rotation is being counteracted.

Thus, the lateral marine drive 15 is likely controlled intermittently during surge motions to effectuate the lateral thrust 115 to counteract any measured yaw change. For example, the direction and magnitude of the lateral thrust 115 may be determined and effectuated by the control system 33 in response to and based on sensed yaw changes, such as based on the direction and magnitude of yaw velocity and/or yaw acceleration of the vessel 10 measured by the IMU 26.

Figure 6C:
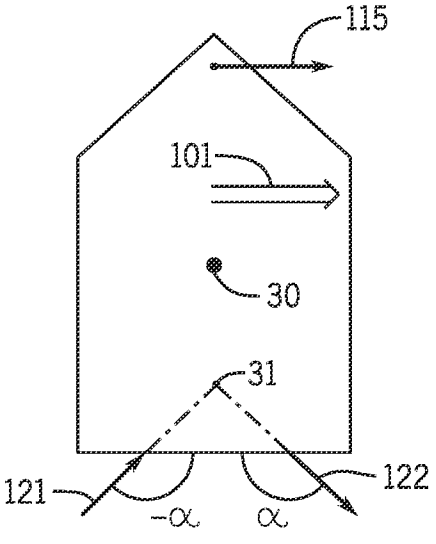
FIGS. 6A-6C depict combinations of thrust vectors by the exemplary propulsion system of FIG. 1 to effectuate exemplary sway movements of the vessel.
Figure 6B:
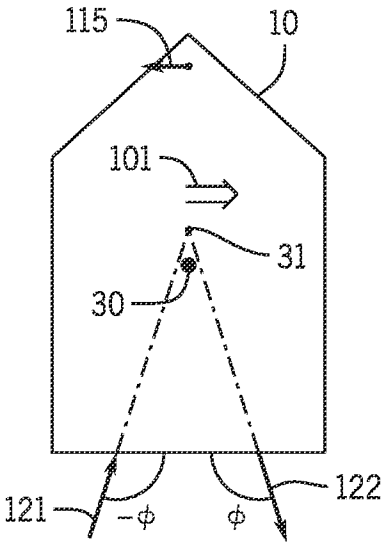
Figure 6A:
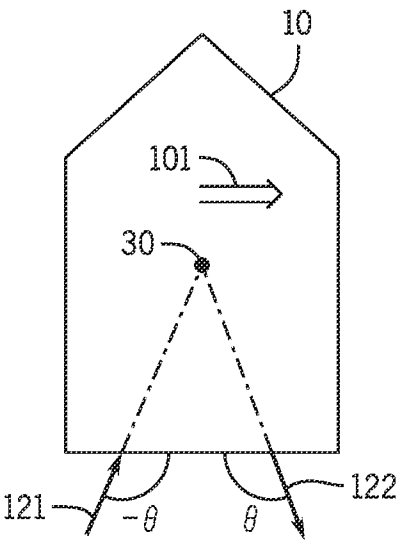

FIGS. 6A-6C exemplify integrated control of lateral and rear marine drives, illustrating forced coupling between the plurality of rear marine drives 21 and 22 and the lateral marine drive 15 to effectuate sway movement of the vessel 10. To effectuate only a sway movement, and thus to move the vessel 10 laterally sideways without causing yaw or surge movements, the control system 33 may utilize only the rear marine drives 21 and 22 splayed outward and generating opposite forward and reverse thrusts, or may utilize the lateral drive 15 and the plurality of rear drives to generate a total commanded sway. Depending on whether the lateral marine drive 15 is operated to oppose or add to the sway component of the total thrust from the rear marine drives 21 and 22, the total sway effectuated by the propulsion system may be decreased on increased.

FIG. 6A depicts an example where the rear marine drives 21 and 22 are operated to generate a sway motion of the marine vessel 10. The marine drives are splayed to opposite steering angles, where the first marine drive 21 is turned to steering angle $-\theta$ and the second marine drive 22 is turned to steering angle $\theta$ such that the thrust vectors of the rear marine drives 21 and 22 intersect at the COT 30. The rear marine drives 21 and 22 are then controlled to effectuate opposite thrust directions, with one generating a forward thrust and the other generating a reverse thrust. The surge and yaw components of the thrusts cancel, resulting in only exerting a total thrust in the sway direction, represented by arrow 101.

In FIG. 6B, the lateral marine drive 15 is operated to oppose the sway thrust from the rear marine drives 21 and 22, and thus to generate a lower sway velocity than is achievable with only the rear marine drives. Here, the rear marine drives 21 and 22 are steered to opposing drive angles $-\Phi$ and $\Phi$, where $\Phi$ is closer to the centered steering position than the steering angle $\theta$ referred to in FIG. 6A. Thus, the thrusts effectuated by the rear marine drives 21 and 22 intersect at intersections point 31, which is in front (toward the bow) of the COT 30. Thus, when the marine drives 21 and 22 are operated to generate opposing thrusts, represented by vectors 121 and 122, a moment is generated resulting in a yaw force in a clockwise direction. The lateral marine drive 15 is utilized to counteract the clockwise rotational force generated from the rear marine drives 21 and 22 is counteracted by the port directional thrust, vector 115, generated by the lateral marine drive at the bow. Thereby, the total sway thrust exerted by the propulsion system, represented by arrow 101, is decreased from that generated by the rear marine drives alone. The steering angle and thrusts of the rear marine drives 21 and 22 and the directions and magnitude of thrust from the lateral marine drive 15 can be balanced to achieve any sway demand within the lowest demand range, such as to achieve a lower sway velocity and/or sway acceleration than is achievable with the rear marine drives 21 and 22 alone.

FIG. 6C illustrates an example where the lateral marine drive is operated in concert with the rear marine drives 21 and 22 to increase the total sway, such as to maximize the sway velocity and/or sway acceleration capabilities of the propulsion system 33. The rear marine drives 21 and 22 are splayed outward to angle $-\alpha$ and $\alpha$, respectively, where a has a greater magnitude than the steering angle $\theta$. Here, the rear drives 21 and 22 are steered to more extreme steering angles than the previous examples, such as to a maximum permitted steering angle for the drives in each of the respective directions. The intersection point 31 of the thrust vectors 121 and 122 is thus significantly behind (toward the stern) the COT 30, thus generating an effective moment. The resulting rotational force, which in this example is in the counterclockwise direction, is counteracted by the moment arm of the thrust 115 from the lateral marine drive 15 in the starboard direction at the bow. Further, sway component of the thrust from the lateral drive 15 is additive to the sway component resulting from the rear marine drives 21 and 22, maximizing the total sway, arrow 101, effectuated by the propulsion system.

The system and method are configured to translate user input at the user input device, such as joystick commands, into coordinated thrust outputs for the lateral and rear marine drives. In one embodiment, the propulsion system 100 is configured with a velocity-based control system 33 where the user inputs are correlated with inertial velocity values for the marine vessel. In one such embodiment, the control system may be a model-based system where the thrust outputs are determined based on modeled vessel behavior that accounts for the vessel dimensions and the locations and thrust capabilities of each of the lateral and rear marine drives. Alternatively, the control system 33 may be configured to utilize a map relating joystick positions to thrust magnitude outputs, including magnitude and direction, for each of the lateral and rear marine drives.

Figure 7:
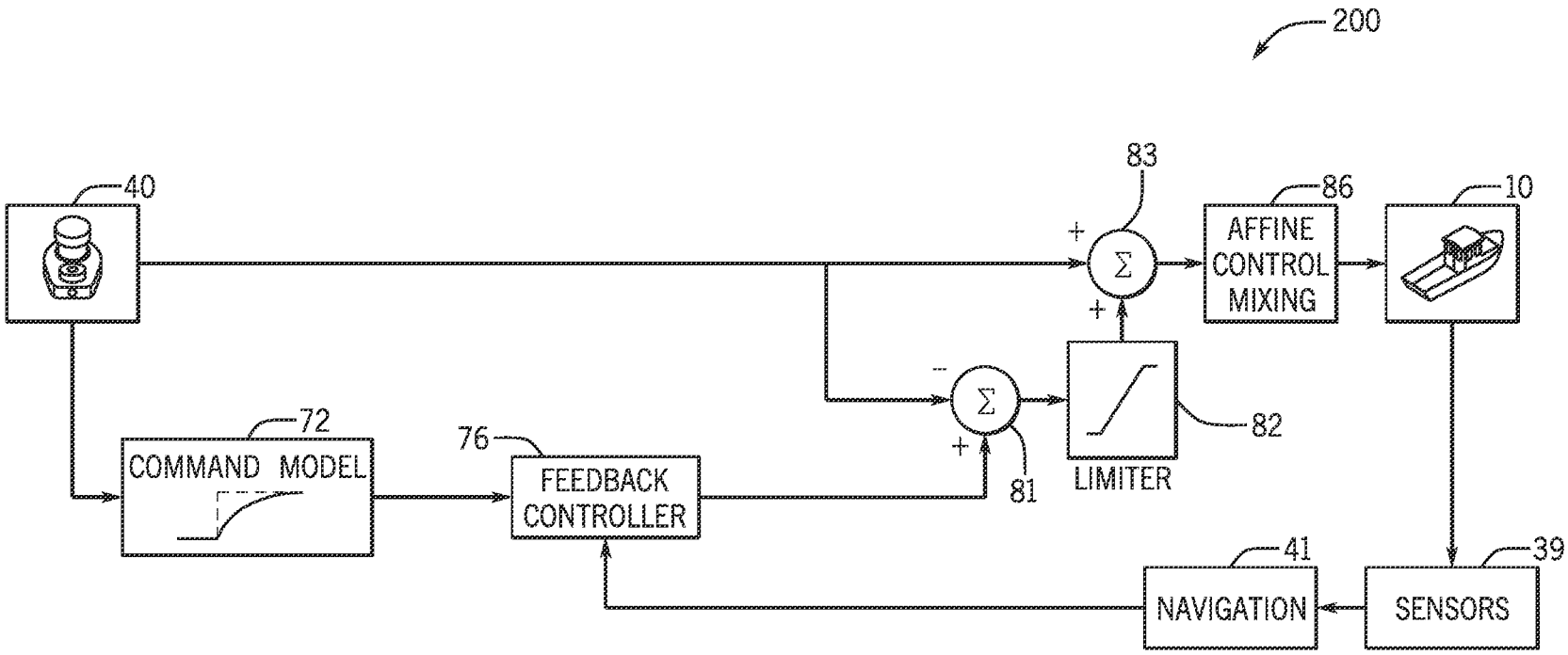
FIG. 7 is a diagram illustrating an exemplary method for controlling propulsion of the marine vessel based on joystick inputs in accordance with the present disclosure.

FIG. 7 is a flowchart schematically depicting one embodiment of a control method 200, such as implemented at the controller 34, for controlling low-speed propulsion of a marine vessel. The depicted method 200 may be implemented upon user engagement of a corresponding control mode to enable precision joystick control, such as a docking mode or other precision control mode. In the depicted embodiment, the control strategy is a closed-loop algorithm that incorporates feedback into the thrust command calculations by comparing a target inertial velocity or target acceleration to an actual measured velocity and/or measured acceleration of the marine vessel to provide accurate control that accounts for situational factors in the marine environment—e.g. wind and current—and any inaccuracies or uncertainties in the model. An affine control mixing strategy is utilized to convert surge (fore/aft) velocity commands, sway (starboard/port) velocity commands, and yaw velocity commands into values that can be used to control the marine drives, including thrust magnitude command values (e.g., demand percent, rotational speed, throttle position, current or torque amounts, etc.), thrust direction commands (e.g., forward or reverse), and steering commands for the steerable drives (e.g., angular steering position). Exemplary embodiments of each aspect of this control strategy are subsequently discussed.

Signals from the joystick user input device 40 (e.g., a percent deflection +/−100% in each of the axis directions) are provided to the command model 72, which computes the desired inertial velocity or desired acceleration based on the raw joystick position information. The inertial velocity may include a surge velocity component, a sway velocity component, and/or a yaw velocity component. The command module 72 is configured based on the thrust capabilities of the drives and the vessel response to accurately approximate fast the vessel will translate and/or turn in response to a user input. In certain embodiments, the command model may be tunable by a user to adjust how aggressively the propulsion system 100 will respond to user inputs. For example, secondary inputs may be provided that allow a user to input preference as to how the vessel will respond to the joystick inputs, such as to increase or decrease the desired inertial velocity values associated with the joystick positions and/or to select stored profiles or maps associated with user input values to desired velocity values. For example, the user inputs may allow a user to instruct an increase or decrease in the aggressiveness of the velocity response and/or to increase or decrease a top speed that the full joystick position (e.g. pushing the joystick to its maximum outer position) effectuates.

For example, the command model 72 may include a map correlating positions of the joystick to inertial velocity values, associating each possible sensed position of the joystick to a target surge velocity, a target sway velocity, and/or a target yaw velocity. For example, the neutral, or centered, position in the joystick is associated with a zero inertial velocity.

Figure 8:
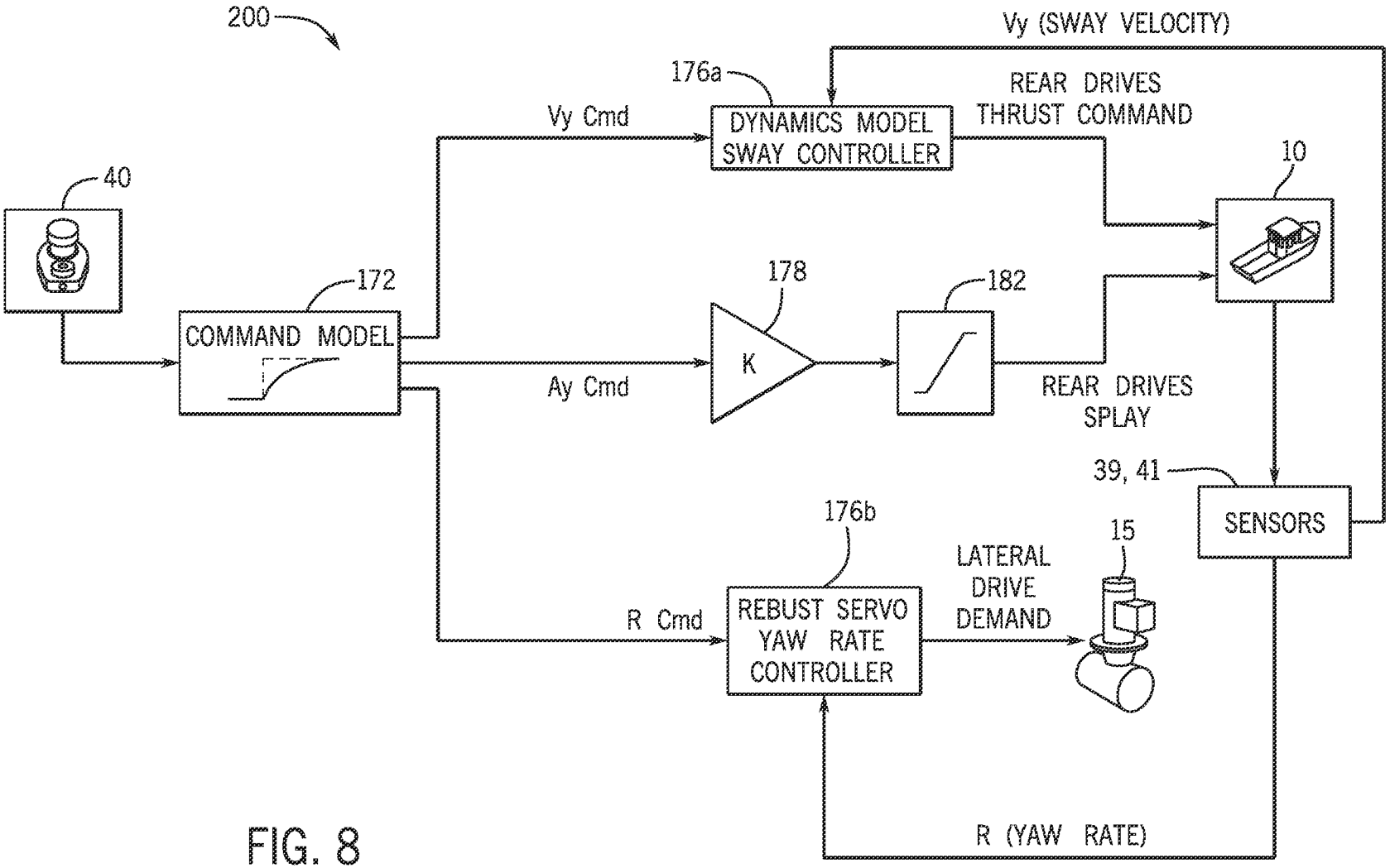
FIG. 8 is a diagram illustrating another exemplary method for controlling propulsion of the marine vessel based on user inputs in accordance with the present disclosure.

Output from the command model 72, such as target surge, sway, and yaw velocities (or could be desired surge, sway, and yaw acceleration), is provided to the drive controller 76. The drive controller 76 is configured to determine thrust commands, including desired thrust magnitude and desired direction, for each of the drives 15, 21, and 22 based on the target surge, sway, and yaw velocities or accelerations. The drive controller 76 may be a model-based controller, such as implementing a vessel dynamics model (e.g., an inverse plant model), optimal control modeling, a robust servo rate controller, a model-based PID controller, or some other model-based control scheme. In a closed-loop vessel dynamics model controller embodiment, the model is utilized to both calculate feed-forward commands and incorporate feedback by comparing a target inertial velocity or target acceleration to an actual measured velocity and/or measured acceleration of the marine vessel. In a robust servo rate controller embodiment, the model is utilized to calculate feed-forward commands and the gains are computed off-line and incorporated into the control algorithm. In some embodiments, two or more different control models may be utilized, such as for calculating thrust commands for different directional control. FIG. 8 exemplifies one such embodiment.

The control model is generated to represent the dynamics and behavior of the marine vessel 10 in response to the propulsion system 100, and thus to account for the hull characteristics and the propulsion system characteristics. The hull characteristics include, for example, vessel length, a vessel beam, a vessel weight, a hull type/shape, and the like. The propulsion system characteristics include, for example, the location and thrust capabilities of each marine drive in the propulsion system 100. In certain embodiments, the model for each vessel configuration may be created by starting with a non-dimensionalized, or generic, vessel model where the hull characteristics and the propulsion system characteristics are represented as a set of coefficients, or variables, that are inputted to create a vessel model for any vessel hull and any propulsion system in the ranges covered by the model. The set of coefficients for the hull characteristics may include, for example, a vessel length, a vessel beam, a vessel weight, and a hull shape or type.

The generic model may be created utilizing stored thrust information (e.g., representing the thrust magnitude generated by the drive at each command value, such as demand percent) associated with a set of predefined drive identification coefficients. An exemplary set of coefficients for the propulsion system characteristics may include location of each marine drive and drive identification information associated with the corresponding thrust characteristics saved for that drive, such as drive type, drive size, and/or make/model, as well as available steering angle ranges for each steerable drive.

Alternatively, the drive controller 76 may implement a different, non-model-based, control strategy, such as a calibrated map correlating the target surge, target sway, and target yaw velocities/accelerations to thrust commands for each drive in the propulsion system 100 or a calibrated map correlating joystick positions to thrust commands for each drive in the propulsion system 100. Additionally, the map may be configured to account for further control parameters in the thrust command determinations, such as battery charge level (e.g., battery SOC), of a power storage system associated with one or more of the marine drives 15, 21, 22, generated fault conditions for one or more of the marine drives 15, 21, 22, or the like, whereby each control parameter is represented as an axis on the map and a corresponding input is provided for determining the thrust commands.

The output of the drive controller 76 is compared to the joystick position information at summing point 81 (e.g., to the percent deflection value). The summed output is again subject to a limiter 82, which limits the authority of the controller 76 and accounts for fault modes. The output of the limiter 82 is summed with the joystick values at summing point 83. That summed value is provided to the affine control mixer 86, which generates a total X and Y direction command for the marine drive. From there, the powerhead control commands, shift/motor direction commands, and steering actuator control commands (for the steerable drives) are determined for each marine drive 15, 21, 22. An exemplary embodiment of affine mixing is described in U.S. Pat. No. 10,926,855, which is incorporated herein by reference.

In certain embodiments, the drive controller 76 may be configured and implemented as a closed-loop control system, wherein the thrust commands are further calculated based on comparison of the measured and target values. In the closed-loop control strategy depicted in FIG. 7, the drive controller 76 is configured to determine the thrust commands based further on a comparison of the target values outputted from the command model 72, namely target surge velocity, target sway velocity, and/or target yaw velocity, to measured velocity and/or acceleration from one or more inertial and/or navigation sensors. Feedback information about the actual vessel velocity and/or acceleration is provided by one or more sensors and/or navigation systems on the marine vessel. For example, the output of the one or more velocity and/or acceleration sensors 39—such as an IMU 26, accelerometers, gyros, magnetometers, etc.—may be interpreted and/or augmented by a navigation system 41, such as a GPS 38 or an inertial navigation system. The navigation system 41 provides an actual inertial velocity (e.g., sway velocity and yaw velocity) and/or an actual acceleration that can be compared to the output of the command model 72. The controller 76 is configured to utilize such information to refine the thrust command values to accurately effectuate the desired inertial velocity, accounting for inaccuracies in the model design, malfunctions or sub-par performance of the marine drives, disturbances in the environment (e.g., wind, waves, and current), and other interferences.

Where the drive controller 76 is a map-based controller, a PID controller may be utilized in conjunction with the map-determined thrust commands to determine the final outputted thrust commands and provide closed-loop control.

Alternatively, control may be implemented in an open-loop, or feed-forward, control strategy. In a feed-forward-only command regime, the output of the drive controller 76 is utilized to control the marine drives—i.e., inputted to the affine control mixer 86 to generate engine and steering commands. Accordingly, the command model 72, drive controller 76, and affine control mixer 86 can be utilized, without the feedback portion of the system depicted in FIG. 7, to control the marine drives 15, 21, 22 in a joysticking mode. This control strategy, which results in a very drivable and safe propulsion system 100, can be implemented on its own as a control strategy or can be implemented as a default state when the feedback portion of a closed-loop control system is inoperable (such as due to failure of navigation systems or sensors).

FIG. 8 depicts an exemplary model-based control method 200 for controlling sway and yaw movement of the vessel. The joystick position is provided to the command model 172, which is configured to output target sway "Vy Cmd"

and target yaw "R Cmd" values based on the joystick position. The command model 172 is also configured to determine the steering angles for the rear marine drives 21 and 22 based on the target sway command and/or the demanded acceleration required to reach the target sway and/or target yaw values. As described above, the greater the steering angles of the rear drives—i.e., the more they are splayed out—the greater the resultant sway component of the total thrust from the rear drives. However, this also creates a larger yaw moment that must be cancelled out by the lateral marine drive 15. The command model 172 is configured to account for the thrust capability of the lateral marine drive, and in some embodiments also the battery SOC and/or other output capability constraints of the lateral marine drive, so as not to splay the drives to an extreme angle that cannot be counteracted by the thrust output of the lateral marine drive.

The steering angles "Ay Cmd" outputted by the command model 172 are provided to a gain calculator 178 configured to calculate the gain and then to limiter 182, which limits the authority to steer the drives 21 and 22 and accounts for fault modes. The target sway velocity VyCmd is provided to a model-based controller 176*a*, such as a vessel dynamics control model described above, configured to calculate the thrust command for each of the rear marine drives 21 and 22, including a thrust magnitude command. (e.g., and engine or motor command value tied to thrust output) and a thrust direction (e.g., forward or reverse).

The target yaw command "R Cmd" output of the command model 172 is provided to the model-based yaw rate controller 176*b*, which in this embodiment is implemented with a robust servo control design to control yaw rate with the lateral marine drive. Thus, the yaw rate controller 176*b* is configured to calculate a thrust command for the lateral marine drive 15, including a thrust magnitude command (e.g., demand percent or some other value tied to thrust output) and a thrust direction (e.g., forward or reverse directions tied to starboard or port thrust direction) provided to the lateral marine drive 15 based on the target yaw command "R Cmd" and the measured yaw command. Where the target yaw command is zero, and thus no yaw motion is desired, the yaw rate controller 176*b* operates to command the lateral drive 15 to generate a counteracting yaw thrust to oppose any unwanted yaw motion. For example, where the user operates the joystick 40 to command a straight rearward motion of the vessel such as exemplified at FIG. 5E, the yaw rate controller 176*b* actuates the lateral drive 15 based on yaw measurements from the sensors 39 (e.g., IMU 26) and/or navigation controller 41 to generate opposing yaw forces (both magnitude and direction) that cancel any unwanted yaw motion of the vessel 10.

The control strategies for the sway and yaw controllers may be implemented as closed-loop algorithms, as shown, where each of the sway and yaw controllers 176*a* and 176*b* incorporates feedback by comparing the target values to measured values. The yaw rate controller 176*b* receives yaw rate measurements from the sensors 39 (e.g., IMU 26) and/or navigation controller 41 and compares the measured value to the yaw command R Cmd. To effectuate a pure sway motion, for example, the yaw rate controller 176*b* will be targeting a yaw rate of zero and will adjust the thrust generated by the lateral marine drive to maintain zero yaw change.

The sway controller 176*a* receives sway velocity measurements from the sensors 39 (e.g., IMU 26) and/or navigation controller 41 and compares the measured value to the sway command "Vy Cmd". To effectuate a pure yaw motion, for example, the yaw rate controller 176*b* will be targeting a sway velocity of zero and will adjust the thrust generated by the rear marine drives to maintain zero sway change.

In some embodiments, one or both of the sway controller 176*a* and yaw controller 176*b* may instead implement an open-loop strategy where the output of one or both of the controllers 176*a*, 176*b* is utilized to control the marine drives based on the respective control models without utilizing any feedback. This control strategy, which results in a very drivable and safe propulsion system 100, can be implemented on its own as a control strategy or can be implemented as a default state when the feedback portion of a closed-loop control system is inoperable (such as due to failure of navigation systems or sensors).

Figure 9B:
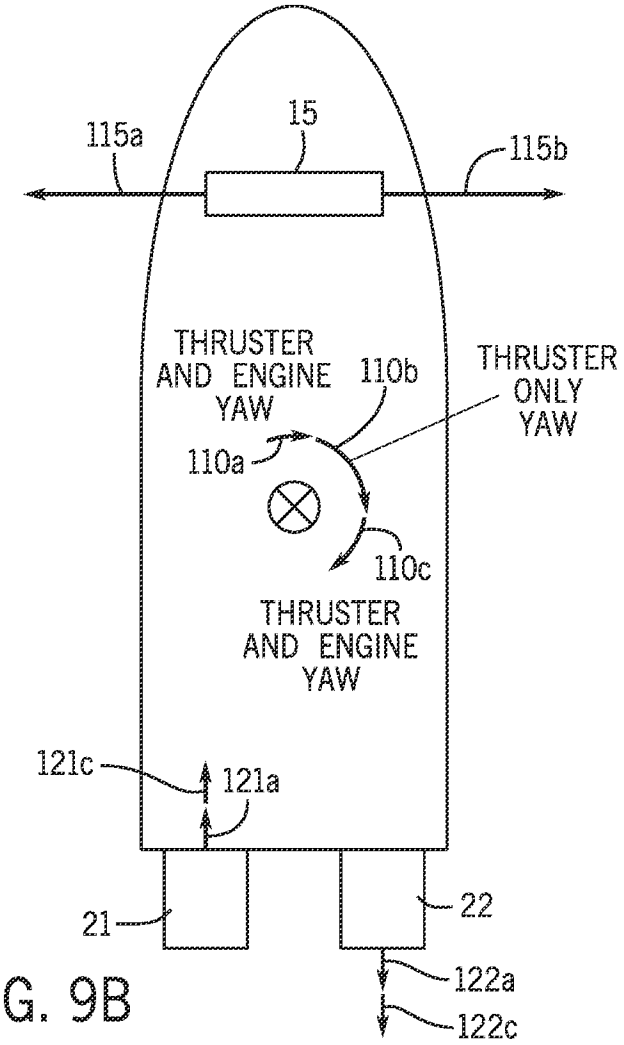
FIGS. 9A-9B illustrate an exemplary joystick control arrangement utilizing rear and lateral marine drives to effectuate yaw movement of the vessel.
Figure 9A:
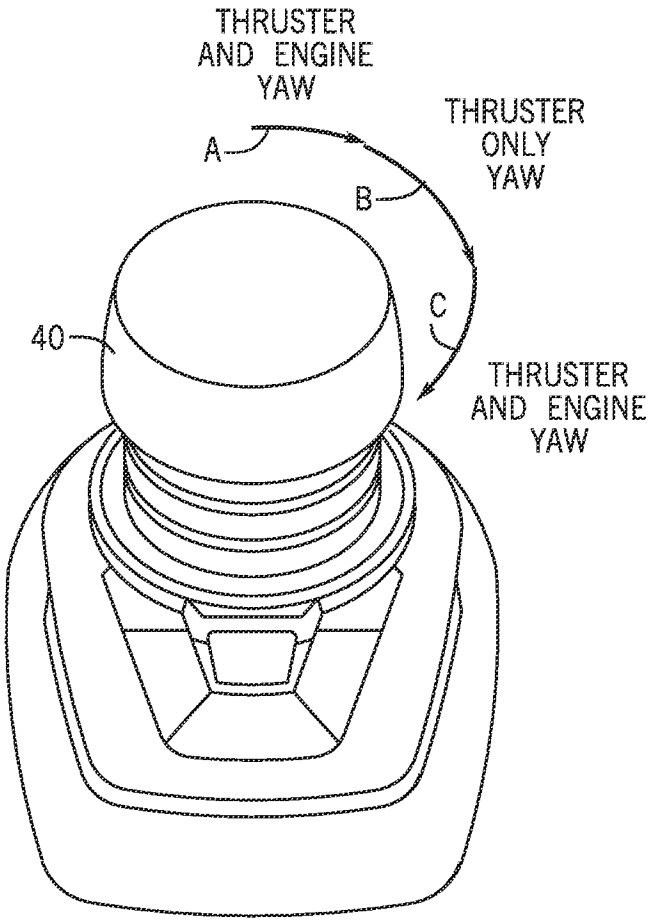

FIGS. 9A and 9B illustrate an exemplary joystick control arrangement utilizing the plurality of rear marine drives 21 and 22 and the lateral marine drive 15 to effectuate yaw movement of the vessel 10. The joystick is movable to a range of positions corresponding with a range of yaw demand. The control system 33 is configured to control the marine drives 15, 21, 22 accordingly. In addition to thrust efficiencies, drive capabilities, and control precision, the control system 33 may also control may be configured to optimize around additional factors, such as conserving battery power and/or minimizing shift and steering activity of the rear marine drives to minimize vibrations and provide a smoother driving experience for the user and passengers. Accordingly, the control system 33 may be configured to operate different subsets of drives in the propulsion system 100 depending on the yaw demand range provided at the joystick 40.

For example, regarding FIG. 9A, the range of possible yaw demand may be divided into a lowest yaw demand range A, a thruster-only mid yaw demand range B, and a high yaw demand range C. In the lowest yaw demand range A, the lateral marine drive 15 is controlled to produce a thrust that opposes a yaw component of the total thrust generated by the rear marine drives 21 and 22. As exemplified in FIG. 9B, a lower total yaw velocity 110*a* can be achieved than is achievable with only the rear marine drives 21 and 22 alone or with only the lateral marine drive 15 alone. The control system 33 is configured to receive user inputs moving the joystick 40 to a position associated with the lowest yaw demand range A and to generate a correspondingly small yaw thrust. The rear marine drives 21 and 22 are effectuated to generate opposing forward and reverse thrusts, represented at vectors 121*a* and 122*a* and an opposing yaw thrust 115*a* from the thruster 15. For example, the lowest yaw demand range A may be between zero yaw demand and a minimum yaw thrust capability of the lateral marine drive 15.

Where the joystick 40 is rotated further to one of a range of joystick positions associated with a mid yaw demand range B, the control system 33 may be configured such that only the thruster is utilized to produce the desired yaw response, resulting in total yaw thrust 110*b*. In some drive configurations, this will reduce shifting from the rear marine drives 21 and 22. In this configuration, moving the joystick 40 to positions associated with the mid yaw demand range B yields only a thrust output 115*b* from the lateral marine drive 15. To provide just one example, the thruster-only mid yaw demand range B may be, for instance, starting at or above the minimum thrust capability of the lateral marine drive 15 up to a predetermined yaw demand threshold, such as 40% yaw demand or 50% yaw demand.

When the propulsion demand input provided by the joystick 40 is within a high yaw demand range C, then the lateral marine drive 15 and the plurality of rear marine drives 21 and 22 are controlled in concert to produce additive yaw thrusts. The high yaw demand range C covers potential turn position magnitudes of the joystick 40 between the top end of the mid range B and a maximum turn position. Referring to FIG. 9B, the rear marine drives 21 and 22 are controlled to produce forward and reverse thrusts 121*c* and 122*c*. The lateral marine drive 15 is controlled to produce an additive thrust 115*b* where the yaw component of lateral thrust 115*b* is in the same yaw direction as the yaw component of the total thrust generated by the at least two rear marine drives 21 and 22. Accordingly, the total yaw velocity 110*c* and acceleration can be maximized to achieve a greater yaw velocity and greater yaw acceleration than is achievable with only the rear marine drives or only the lateral marine drive.

The foregoing yaw control can be implemented using either model-based or map-based control, and in either an open-loop or a close-loop control, as is described above. Further, in a case where a power storage device 19 associated with the lateral marine drive 15 is known to be degraded and/or has a low charge level, the control system 33 may be configured to supplement and minimize the use of the lateral marine drive 15 with thrust produced by the rear marine drives 21 and 22, such as by minimizing the thruster-only mid yaw demand range B of joystick positions.

Through model-based control design or closed-loop feedback control arrangements, similar yaw precision can be achieved for the lowest demand range A where the lateral marine drive 15 is a discreet drive that operates only at a predetermined rotational speed by applying thrust in the opposite direction of that produced by the rear marine drives 21 and 22, and then using variable thrust output from the rear marine drives 21 and 22 in the desired yaw direction to achieve slow turn rates. Another strategy for producing yaw in the lowest yaw demand range A or in the mid demand range B using a discrete lateral marine drive 15 would be through modulation of the on-off state of the lateral marine drive 15 at intervals specified by the model-based yaw controller or via closed-loop feedback.

Figure 10B:
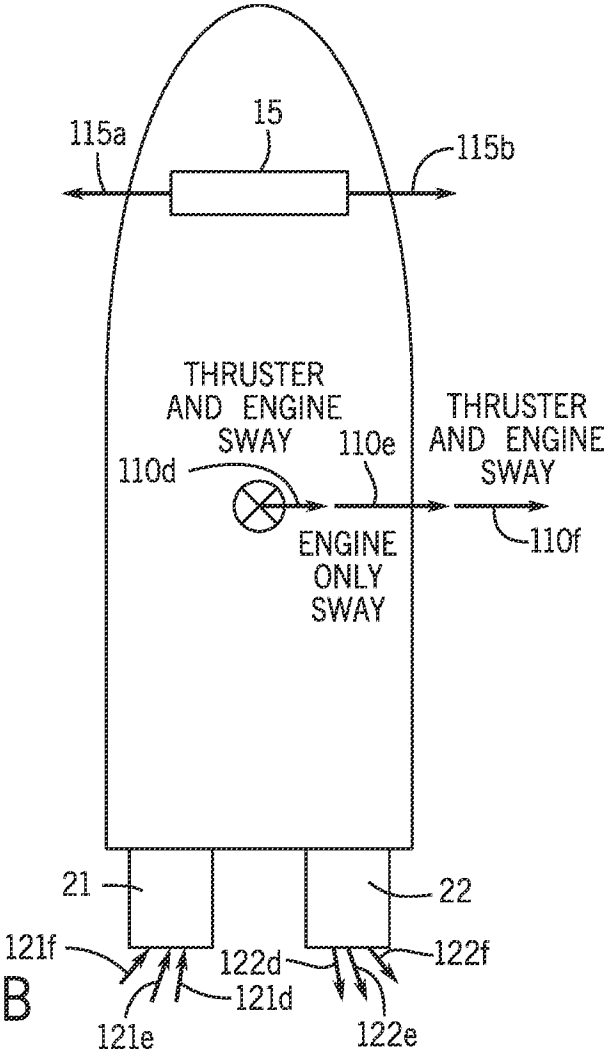
FIGS. 10A-10B illustrate an exemplary joystick control arrangement utilizing rear and lateral marine drives to effectuate sway movement of the vessel.
Figure 10A:
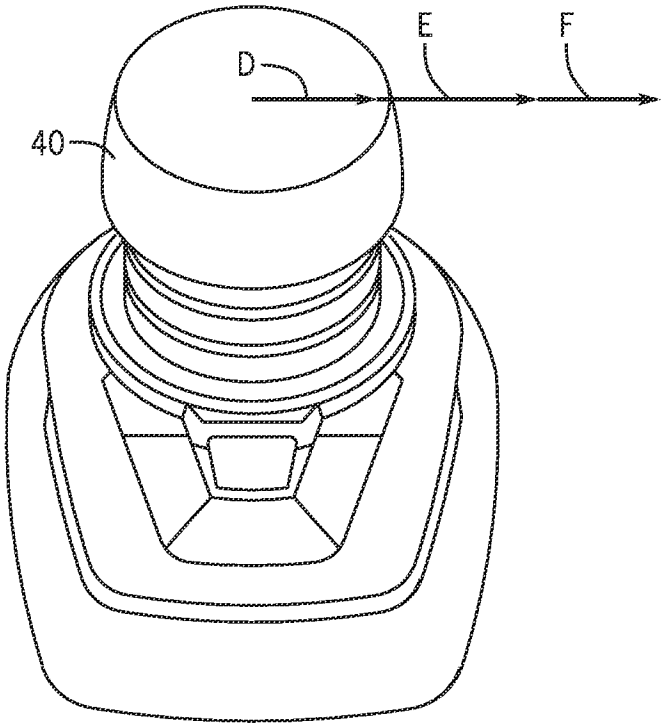

FIGS. 10A and 10B illustrate an exemplary joystick control arrangement utilizing the plurality of rear marine drives 21 and 22 and/or the lateral marine drive 15 to effectuate sway movement of the vessel 10. In one embodiment where both the lateral and rear drives are used to effectuate sway movement, calibration and/or modeling of vessel capabilities determines a range over which the sway authority is maximized utilizing only the rear marine drives 21 and 22, at which point the lateral marine drive 15 is either turned on (where the lateral marine drive 15 is a discrete drive) or fazed in proportionally (where the lateral marine drive 15 is a variable drive). This adds to the sway authority of the propulsion system 100, but also requires that the rear marine drives 21 and 22 be splayed out further to meet high yaw demands and thus to impart a yaw moment.

As is described above discussing FIGS. 6A-6C, the additional splay results in a greater sway component of thrust from the rear marine drives 21 and 22, but requires engagement of the lateral marine drive 15 to counteract the resulting yaw. Thus, a greater velocity and sway acceleration can be achieved utilizing the lateral marine drive 15 to provide an additive sway force to that generated by the rear marine drives 21 and 22. Conversely, operating the lateral marine drive 15 to oppose the sway thrust generated by the rear marine drives 21 and 22 can result in a lower velocity and sway acceleration than is otherwise achievable using only the rear marine drives or only the lateral marine drive.

Accordingly, the control system 33 may be configured to activate only a subset of the lateral marine drive and/or the rear marine drives based on the joystick 40 position being within one of a lowest sway demand range D, an engine-only mid sway demand range E, and a high sway demand range F. When the joystick 40 is in a position associated with the lowest sway demand range D, the marine drives 15, 21, 22 are operated to effectuate thrusts similar to those discussed above with respect to FIG. 6B. The rear marine drives 21 and 22 are splayed to minimum splay angles and operated in opposite directions such that forward and reverse thrusts 121*d* and 122*d* are generated. An opposing sway thrust 115*d* is generated by the lateral marine drive 15 to minimize the total sway velocity 110*d* and acceleration on the vessel.

Joystick positions 40 in a mid-range may be effectuated utilizing only the rear marine drives 21 and 22. For example, the mid sway demand range E may be defined based on the minimum and maximum thrust constraints and capabilities of the rear marine drives 21 and 22—i.e., the minimum and maximum total sway thrusts that can be effectuated utilizing only the rear marine drives 21 and 22. Thus, when the joystick 40 is positioned to command sway thrust in the mid sway demand range E, only the rear marine drives 21 and 22 are controlled to effectuate thrusts 121*e* and 122*e* resulting in total sway thrust 110*e*.

In a high sway demand range F, the control system 33 is configured to operate the lateral marine drive 15 to add sway thrust to that generated by the rear marine drives 21 and 22. This arrangement is exemplified and described above with respect to FIG. 6C. Referring to FIG. 10B, the rear marine drives 21 and 22 are splayed out further to steering angle magnitudes greater than those used for implementing sway thrust associated with the mid demand range E. The rear marine drives 21 and 22 are controlled in opposite directions to effectuate forward and reverse thrusts 121*f* and 122*f*. The lateral marine drive 15 is controlled to effectuate thrust 115*f* in the same sway direction as the sway component of the total thrust from the rear marine drives 21 and 22. Accordingly, the total sway thrust 110*f* is greater than that achieved by the rear marine drives alone or by the lateral marine drive alone.

This written description uses examples to disclose the invention, including the best mode, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

We claim:

1. A marine propulsion system for a marine vessel comprising:

at least two steerable rear marine drives that each generate forward and reverse thrusts, wherein each rear marine drive is independently steerable to a range of steering angles;

a lateral marine drive configured to generate starboard and port thrusts on the marine vessel;

a user input device operable by a user to provide a propulsion demand input commanding sway movement of the marine vessel and yaw movement of the marine vessel;

a control system configured to:

determine a thrust command for each of the lateral marine drive and the at least two rear marine drives and a steering position command for each of the at least two rear marine drives based on the propulsion demand input; and control steering and thrust of each of the at least two rear marine drives based on the thrust command and the steering position command for each of the at least two rear marine drives and control thrust of the lateral marine drive based on the thrust command for the lateral marine drive so as to generate the sway movement and/or the yaw movement commanded by the user.

2. The system of claim 1, wherein the lateral marine drive is positioned at a bow region of the marine vessel and is one of a discrete drive that operates only at a predetermined rotational speed and a variable speed drive wherein the rotational speed is controllable by the control system.

3. The system of claim 2, wherein the lateral marine drive is a thruster and wherein each of the rear marine drives is positioned to extend rearward of a stern of the marine vessel and includes an engine or an electric motor powering rotation of a propulsor.

4. The system of claim 1, wherein the control system is configured to operate both the lateral marine drive and the at least two rear marine drives when the propulsion demand input is within a high yaw demand range and/or a high sway demand range such that the lateral marine drive produces a thrust additive to a yaw and/or sway component of a total thrust of the at least two rear marine drives to achieve greater yaw or sway velocity and/or greater yaw or sway acceleration than is achievable with the at least two rear marine drives alone or with the lateral marine drive alone.

5. The system of claim 1, wherein the control system is configured to operate both the lateral marine drive and the at least two rear marine drives when the propulsion demand input is within a lowest yaw demand range and/or a lowest sway demand range such that the lateral marine drive produces a thrust that opposes a yaw and/or sway component of a total thrust of the at least two rear marine drives to achieve a lower yaw or sway velocity and/or a lower yaw or sway acceleration than is achievable with the at least two rear marine drives alone or with the lateral marine drive alone.

6. The system of claim 1, wherein the control system is configured to operate only the lateral marine drive to generate yaw thrust when the propulsion demand input is within a mid yaw demand range.

7. The system of claim 1, wherein the control system is configured to operate only the at least two rear marine drives to generate sway thrust when the propulsion demand input is within a mid sway demand range.

8. The system of claim 1, wherein the user input device is configured to be operated in a first mode to control only the at least two rear marine drives, a second mode to control both the lateral marine drive and the at least two rear marine drives, and a third mode to control only the lateral marine drive; and wherein the control system is configured to receive user selection of the second mode prior to controlling steering and thrust of each of the at least two rear marine drives and thrust of the lateral marine drive based on the propulsion demand input.

9. The system of claim 1, further comprising a control model stored in memory accessible by the control system, the control model representing hull characteristics and propulsion system characteristics for the marine vessel; and wherein the control system is configured to utilize the control model to determine a thrust command for the lateral marine drive and each of the at least two rear marine drives.

10. The system of claim 9, wherein the control system is further configured to associate the propulsion demand input with a target velocity and/or a target acceleration and to utilize the control model to solve for at least one of a surge command, a sway command, and a yaw command for each of the lateral marine drive and the at least two rear marine drives based on the target velocity and/or the target acceleration.

11. The system of claim 9, wherein the control model is based on at least a vessel length of the marine vessel, a vessel beam of the marine vessel, a location of each marine drive, a thrust capability of each marine drive, and the range of steering angles for each rear marine drive.

12. The system of claim 1, wherein the control system is further configured to determine the thrust command for each of the lateral marine drive and the at least two rear marine drives and the steering position command for the at least two rear marine drives based on a number of marine drives in the marine propulsion system, and a location of each of at least the lateral marine drive and the at least two rear marine drives with respect to a center of turn of the marine vessel.

13. The system of claim 1, wherein the control system is further configured to determine at least one of the thrust commands based on a charge level of a power storage device associated with at least one of the lateral marine drive and the at least two rear marine drives.

14. The system of claim 1, further comprising a map stored in memory accessible by the control system, the map configured to correlate all possible propulsion demand inputs from the user input device to thrust commands for each of the lateral marine drive and each of the at least two rear marine drives;

wherein the control system is configured to utilize the map to determine a thrust command for each of the lateral marine drive and the at least two rear marine drives based on the propulsion demand input.

15. The system of claim 14, wherein the map is further configured to correlate a charge level of a battery associated with at least one of the lateral marine drive and the at least two rear marine drives to thrust commands for each of the lateral marine drive and each of the at least two rear marine drives.

16. A method of controlling a marine propulsion system for a marine vessel, the method comprising:

receiving from a user input device a propulsion demand input commanding a sway movement of the marine vessel and/or a yaw movement of the marine vessel;

determining a rear thrust command and a steering position command for each of at least two rear marine drives based on the propulsion demand input, wherein each rear marine drive generates forward and reverse thrusts is independently steerable to a range of steering angles;

determining a lateral thrust command based on the propulsion demand input for a lateral marine drive configured to generate starboard and port thrusts on the marine vessel; and controlling each of the at least two rear marine drives based on the rear thrust command and the steering position command for each of the at least two rear marine drives and controlling the lateral marine drive based on the lateral thrust command so as to generate the sway movement and/or the yaw movement commanded by the propulsion demand input.

17. The method of claim 16, wherein the rear thrust commands and the steering position commands for the at least two rear marine drives and the lateral thrust command for the lateral marine drive is based on the propulsion demand input, a number of marine drives operating in the marine propulsion system, and a location of each of at least the lateral marine drive and the at least two rear marine drives with respect to a center of turn of the marine vessel.

18. The method of claim 17, wherein the rear thrust commands and the steering position commands for the at least two rear marine drives and the lateral thrust command for the lateral marine drive is further based on a charge level of a battery associated with at least one of the lateral marine drive and the at least two rear marine drives.

19. The method of claim 16, further comprising, when the propulsion demand input is within a lowest yaw demand range and/or a lowest sway demand range, controlling the lateral marine drive to produce a thrust that opposes a yaw and/or sway component of a total thrust of the at least two rear marine drives to achieve a lower yaw or sway velocity and/or a lower yaw or sway acceleration than is achievable with the at least two rear marine drives alone or with the lateral marine drive alone.

20. The method of claim 16, further comprising, when the propulsion demand input is within a high yaw demand range and/or a high sway demand range, controlling the lateral marine drive to produce a thrust additive to a yaw and/or sway component of a total thrust of the at least two rear marine drives to achieve a greater yaw or sway velocity and/or greater yaw or sway acceleration than is achievable with the at least two rear marine drives alone or the lateral marine drive alone.

21. The method of claim 16, further comprising operating only the lateral marine drive to generate yaw thrust when the propulsion demand input is within a mid yaw demand range.

22. The method of claim 16, further comprising operating only the at least two rear marine drives to generate sway thrust when the propulsion demand input is within a mid sway demand range.

23. The method of claim 16, further comprising storing a control model representing hull characteristics and propulsion system characteristics; and utilizing the control model to determine each of the rear thrust commands and the lateral thrust command.

24. The method of claim 16, wherein determining the lateral thrust command includes utilizing a closed-loop yaw controller to determine the lateral thrust command based at least in part on sensed yaw motion of the marine vessel.

25. The method of claim 24, wherein the propulsion demand input commands zero yaw movement, and wherein a magnitude and a direction of the lateral thrust command is determined based on the sensed yaw motion to generate an opposing yaw thrust.

26. The method of claim 16, further comprising storing a map configured to correlate all possible propulsion demand inputs from the user input device to thrust commands for each of the lateral marine drive and each of the at least two rear marine drives;

utilizing the map to determine the lateral thrust command and the rear thrust commands.

* * * * *